US012759740B2

(12) United States Patent
Holmes et al.

(10) Patent No.: US 12,759,740 B2
(45) Date of Patent: Oct. 13, 2026

(54) AUTOMATIC BLISTER CARD PACKAGER

(71) Applicant: RXSAFE LLC, Vista, CA (US)

(72) Inventors: William K. Holmes, San Diego, CA (US); Tom F. Gaasch, Encinitas, CA (US)

(73) Assignee: RXSAFE LLC, Vista, CA (US)

( * ) Notice: Subject to any disclaimer, the term of this patent is extended or adjusted under 35 U.S.C. 154(b) by 0 days.

(21) Appl. No.: 19/029,168

(22) Filed: Jan. 17, 2025

(65) Prior Publication Data

US 2026/0208896 A1 Jul. 23, 2026

(51) Int. Cl.
*B65B 9/04* (2006.01)
*B65B 43/44* (2006.01)
*B65B 43/46* (2006.01)

(52) U.S. Cl.
CPC ..... *B65B 9/045* (2013.01); *B65B 43/44* (2013.01); *B65B 43/46* (2013.01)

(58) Field of Classification Search
CPC ..... B65B 9/045; B65B 43/44; B65B 43/46
See application file for complete search history.

(56) References Cited

U.S. PATENT DOCUMENTS 3,195,284 A * 7/1965 Crane, Jr. ..... B65B 11/52 53/477
3,701,297 A 10/1972 Kovic
3,874,143 A * 4/1975 Braber ..... B65D 75/327 53/133.8
3,946,537 A * 3/1976 Hair ..... B65B 47/02 53/329.3
5,329,750 A * 7/1994 Bagley ..... B65B 11/50 53/559
5,623,816 A * 4/1997 Edwards ..... B29C 66/849 53/499

(Continued)

FOREIGN PATENT DOCUMENTS

CN 115571432 A 1/2023
EP 2754614 A1 7/2014

(Continued)

OTHER PUBLICATIONS

"BlistAssist by RxSafe | Blister Card Filling Automation Solution" by RxSafe, a YouTube video uploaded Nov. 27, 2018; https://www.youtube.com/watch?v=kzJNBhYTD2I (Year: 2018) (1 page).

(Continued)

*Primary Examiner* — Lucas E. A. Palmer
(74) *Attorney, Agent, or Firm* — Michael Best & Friedrich LLP

(57) ABSTRACT

An automatic blister card packager may include a platen configured to receive a blister card. The automatic blister card packager may include a loading station including a loader configured to retrieve an empty blister card from a stack of blister cards and deposit the empty blister card on the platen. The automatic blister card packager may include a filling station configured to fill the empty blister card supported by the platen with medications. The automatic blister card packager may include a discharging station including a discharger configured to retrieve the filled blister card from the platen and discharge the filled blister card from the automatic blister card packager.

15 Claims, 18 Drawing Sheets

(56) References Cited

U.S. PATENT DOCUMENTS 5,720,154 A 2/1998 Lasher et al.
5,771,657 A 6/1998 Lasher et al.
6,604,342 B1 * 8/2003 Appelbaum ..... B65B 11/50 53/374.8
6,805,259 B2 * 10/2004 Stevens ..... B65B 5/103 221/124
6,898,919 B2 5/2005 Kim
7,225,597 B1 * 6/2007 Knoth ..... B65B 5/103 53/244
7,765,776 B1 8/2010 Leu et al.
7,934,355 B2 * 5/2011 Strub ..... B65B 5/103 221/71
8,406,916 B2 3/2013 Bentele et al.
10,317,348 B2 6/2019 Van Den Brink
10,926,901 B2 2/2021 Kim
11,299,307 B2 * 4/2022 Haller ..... B65G 47/914
11,673,698 B2 6/2023 Lebel et al.
2003/0213555 A1 * 11/2003 Bernardi ..... B65B 7/2878 156/308.2
2004/0094050 A1 5/2004 Ackley, Jr. et al.
2004/0261371 A1 * 12/2004 Agostini ..... B65B 43/44 53/253
2005/0145605 A1 7/2005 Faour et al.
2008/0116106 A1 5/2008 Lampropoulos et al.
2008/0223001 A1 9/2008 Monti
2009/0044489 A1 2/2009 Siegel
2009/0044497 A1 2/2009 Falat et al.
2009/0050267 A1 * 2/2009 Conlon ..... B65C 1/045 156/379
2009/0133362 A1 * 5/2009 Bentele ..... B65B 35/18 53/54
2009/0173779 A1 * 7/2009 Szesko ..... G16H 20/13 235/375
2009/0260322 A1 10/2009 Fischer et al.
2009/0320721 A1 * 12/2009 Knoth ..... B65B 5/103 108/20
2009/0321465 A1 * 12/2009 Knoth ..... G07F 17/0092 221/1
2009/0321469 A1 * 12/2009 Knoth ..... B65B 5/103 221/7
2009/0321472 A1 * 12/2009 Knoth ..... B65B 5/103 221/124
2010/0089997 A1 * 4/2010 Carson ..... G07F 11/1653 235/375
2010/0175352 A1 7/2010 Soloman
2010/0251666 A1 10/2010 Gonzalez et al.
2011/0071185 A1 3/2011 Bunick et al.
2011/0083940 A1 * 4/2011 Nazari ..... B65B 51/14 198/570
2011/0094327 A1 * 4/2011 Knoth ..... B65B 5/103 74/490.09
2011/0208352 A1 * 8/2011 Knoth ..... B65B 5/103 700/243
2011/0278319 A1 * 11/2011 Knoth ..... B65B 5/103 235/494
2011/0303692 A1 12/2011 Kim
2012/0290129 A1 * 11/2012 Luciano, Jr. ..... B65B 5/103 700/244
2012/0296592 A1 11/2012 Luciano, Jr. et al.
2013/0212987 A1 * 8/2013 Shigeyama ..... B65B 35/32 53/493
2013/0318931 A1 * 12/2013 Holmes ..... G07F 11/165 53/562
2014/0025545 A1 * 1/2014 Carson ..... G07F 9/009 705/29
2014/0230376 A1 8/2014 Knoth
2014/0318078 A1 10/2014 Kondo et al.
2014/0367301 A1 12/2014 Kim
2015/0127145 A1 * 5/2015 Kim ..... G16H 40/67 700/235
2016/0304229 A1 10/2016 Hellenbrand
2017/0015445 A1 1/2017 Holmes
2017/0016836 A1 * 1/2017 van den Brink ..... A61J 7/0084
2017/0057682 A1 * 3/2017 Chudy ..... B65D 75/327
2018/0265232 A1 * 9/2018 Kim ..... B65B 43/54
2018/0308014 A1 10/2018 White et al.
2019/0107501 A1 4/2019 Mehregany
2019/0112080 A1 * 4/2019 Holmes ..... B65B 57/14
2019/0127094 A1 5/2019 Noda
2019/0127102 A1 5/2019 Chudy et al.
2019/0337647 A1 * 11/2019 Yokoyama ..... G07F 13/025
2020/0182799 A1 6/2020 Inoguchi
2020/0182800 A1 6/2020 Inoguchi
2020/0391887 A1 * 12/2020 Takada ..... G07F 11/44
2023/0141858 A1 * 5/2023 Arsenault ..... B65B 43/54 206/538
2023/0184692 A1 6/2023 Oda et al.
2024/0040230 A1 2/2024 Taguchi et al.
2024/0158117 A1 5/2024 Kim
2025/0256877 A1 * 8/2025 Singh ..... B65B 35/40
2025/0256880 A1 8/2025 Gessner et al.

FOREIGN PATENT DOCUMENTS

GB 722485 A 1/1955
JP 2020016506 A 1/2020
WO 2017043430 A1 3/2017
WO 2019075462 A1 4/2019
WO 2019172317 A1 9/2019
WO 2019195629 A1 10/2019
WO 2020057807 A1 3/2020
WO 2021080353 A2 4/2021
WO 2022211423 A1 10/2022

OTHER PUBLICATIONS

RapidCardRx, Multi-Med, Single Dose, Pre-Pack Adherence Blister Card Packager with Universal Cartridges for any Pharmacy, Product Literature, revised Mar. 30, 2020, (2 Pages).
RapidCardRx, Blister Card Filling Automation, Product information from website: https://rxsafe.com/solutions/rapidcardrx/, accessed Apr. 1, 2020, (9 Pages).
RxSafe, LLC, Announces New Blister Card Pakaging Automation, website: https://www.prweb.com/releases/rxsafe_lie_announces_new_blister_card_packaging_automation/prweb17017233.htm, Mar. 31, 2020, (3 Pages).
International Search Report with Written Opinion for related Application No. PCT/US2021/025314 dated Aug. 17, 2021, (16 Pages).
BlistAssist by RxSafe, Blister Card Filling Automation Solution (RxSafe), Nov. 27, 2018, retrieved from URL: https://www.youtube.com/watch?v=kzJNBhYTD2I>, 2 screenshots.

* cited by examiner

AUTOMATIC BLISTER CARD PACKAGER

FIELD

The present disclosure relates to automatic blister card packager.

BACKGROUND

Pharmacies use several types of packaging to provide pharmaceutical products or medications to consumers. The types of packaging may include strip packages, blister cards, pill vials, and the like. Pill vials and strip packages are most appropriate for individual customers of retail pharmacies. However, institutional customers, for example, nursing homes, palliative or hospice facilities, hospitals, and the like use blister cards extensively.

SUMMARY

Current blister card packaging machines are slow and inaccurate. These blister card packaging machines may require a lot of human interaction and may not be able to verify whether the blister cards are correctly packaged resulting in a lot of error, which further slows down the packaging process. As such, these blister card packages may not provide sufficient gains over human packaging. Accordingly, there is a need for an automatic blister card packager that is faster and more accurate than current blister card packaging techniques. The automatic blister card packager disclosed herein drastically reduces the packaging time and increases the accuracy of packaging. The average packing time for a blister card may be reduced to about 1 minute or less due to the multi-tasking nature of the automatic blister card packager disclosed herein.

In some aspects, the techniques described herein relate to an automatic blister card packager including: a platen configured to receive a blister card; a loading station including a loader configured to retrieve an empty blister card from a stack of blister cards and deposit the empty blister card on the platen; a filling station configured to fill the empty blister card supported by the platen with medications; and a discharging station including a discharger configured to retrieve the filled blister card from the platen and discharge the filled blister card from the automatic blister card packager.

In some aspects, the techniques described herein relate to a blister card loader including: a base for storing a stack of blister cards, the base moveable along a track; a loader configured to retrieve an empty blister card from the stack of blister cards; and a platen configured to receive the empty blister card from the loader for filling, wherein the base is configured to move along the track towards the loader in response to the loader retrieving the empty blister card from the stack of blister cards.

DETAILED DESCRIPTION

Before any examples, features, aspects, or embodiments are explained in detail, it is to be understood that the examples, features, aspects, or embodiments are not limited in their application to the details of construction and the arrangement of components set forth in the following description or illustrated in the following drawings. The examples, features, aspects, or embodiments are capable of being practiced or of being carried out in various ways.

Figure 1:
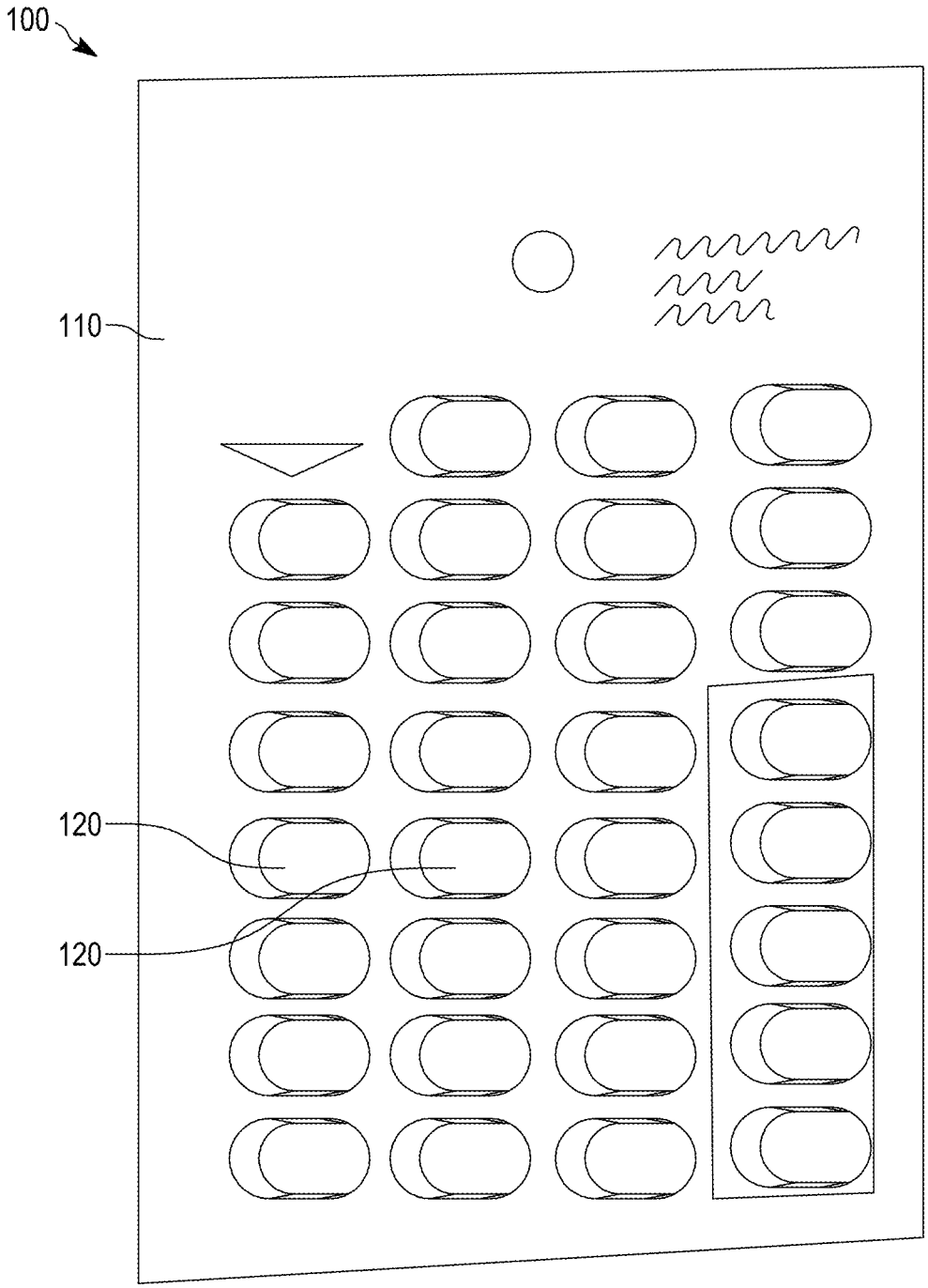
FIG. 1 illustrates a blister card in accordance with some examples.

FIG. 1 illustrates an example of a blister card 100. The blister card 100 includes a blister sheet 110 having a one or more of blister compartments 120, for example, twenty-eight to thirty-two depending on the configuration of the blister card 100. Each blister compartment 120 may receive a single unit of medication (e.g., single-unit blister card) or may receive more than a single unit of medication (e.g., multi-unit blister card). Examples are described below with respect to single-unit blister card filling. However, the features and techniques disclosed herein are equally applicable to multi-unit blister card filling with or without minor modifications. The blister cards 100 are stackable such that the blister compartments 120 of a first blister card 100 above a second blister card 100 fit into the blister compartments 120 of the second blister card.

Figure 2:
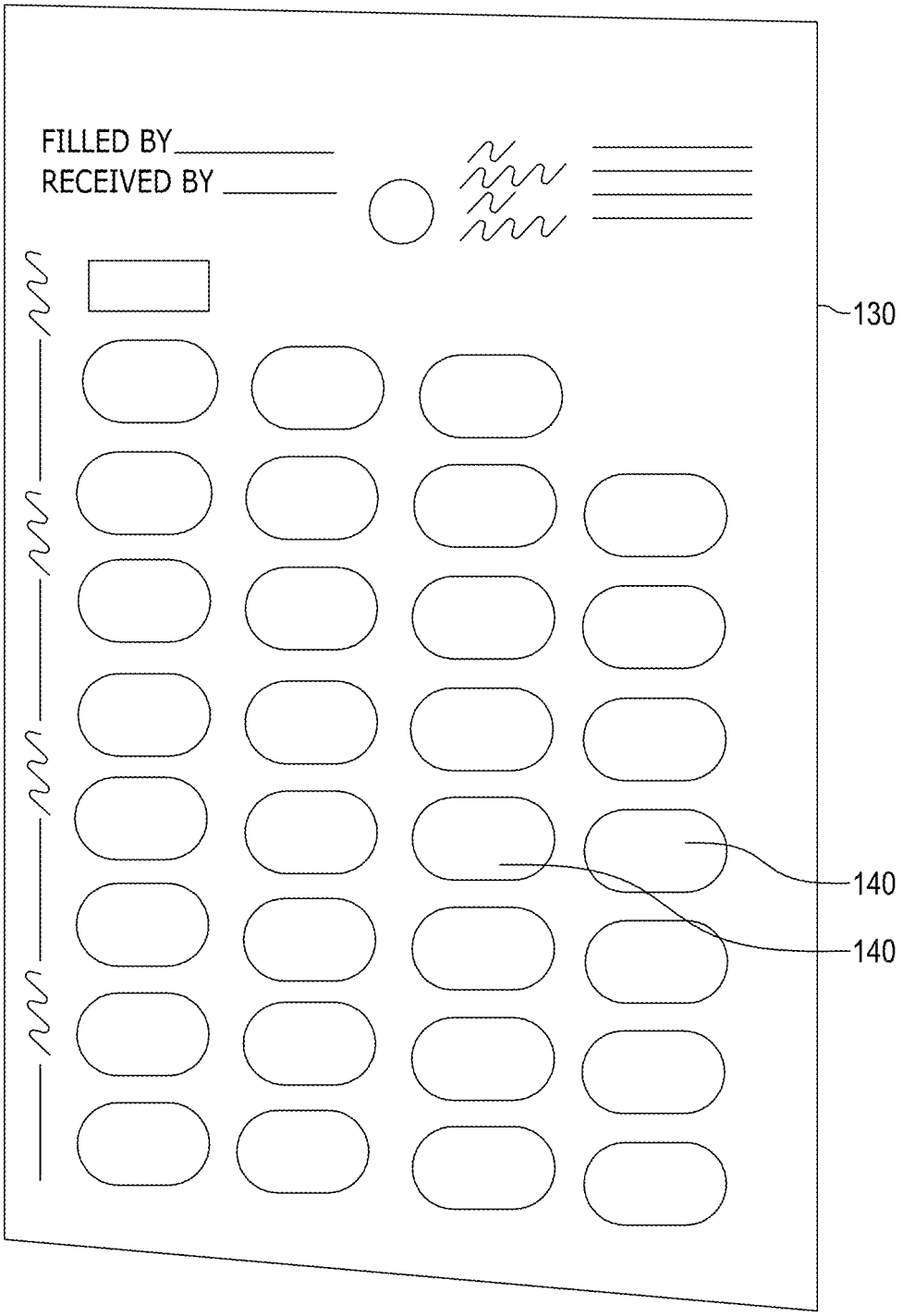
FIG. 2 illustrates a lid for the blister card of FIG. 1 in accordance with some examples.

FIG. 2 illustrates an example lid 130. When the blister compartments 120 are filled, a lid 130 is attached to the back of the blister sheet 110 to seal the blister compartments 120. The lid 130 includes information regarding the blister card 100 including, for example, a facility name, a patient name, a medication name, a medication dose, and the like. The lid 130 includes seal portions 140 aligned with each blister compartment 120 such that a user may tear the seal portions 140 to retrieve the packaged medication. The lid 130 is adhesive-backed such that it will stick and seal the blister sheet 110 when applied to the blister card 100. The lid 130 may be available in a roll. The roll may include a liner on which the lids 130 are provided. The lids 130 (e.g., in the form of sheets) may be peeled from the liner to be applied to the blister cards 100. The lids 130 may be made of flexible cardboard including a multi-layered structure. The multi-layered structure may include a top printable layer and a bottom layer including an adhesive that allows the lid 130 to be stuck onto the blister sheet 110. A middle layer may be provided including a foil or wax paper that forms the seal portions 140 that is exposed through blister-shaped holes in the top layer and the bottom layer. The top printable layer may include pre-printed information, for example, a logo, company name, or identifying information of the pharmacy, healthcare facility, or the like.

In the example illustrated in FIGS. 1-2, the blister card 100 is a standard 6"×9" card. In other examples, the blister card 100 may be other sizes. The blister card 100 may be used for filling different amounts of pills for different periods of time. For example, the blister card 100 may be used for one week of pills (e.g., 7 pills), for up to four weeks or a month of pills (e.g., 28-31 pills), or more. In some examples, the blister card 100 is a "pre-pack" having only one medication in some or all the blister compartments 120. In other examples, the blister card 100 may include more than one pill in the same blister compartment 120 or distributed among the different blister compartments 120. The lid 130 may be cold sealed or hot sealed with the blister sheet 110 after filling. In some examples, identification and prescription information may be printed on the lid 130.

Figure 3:
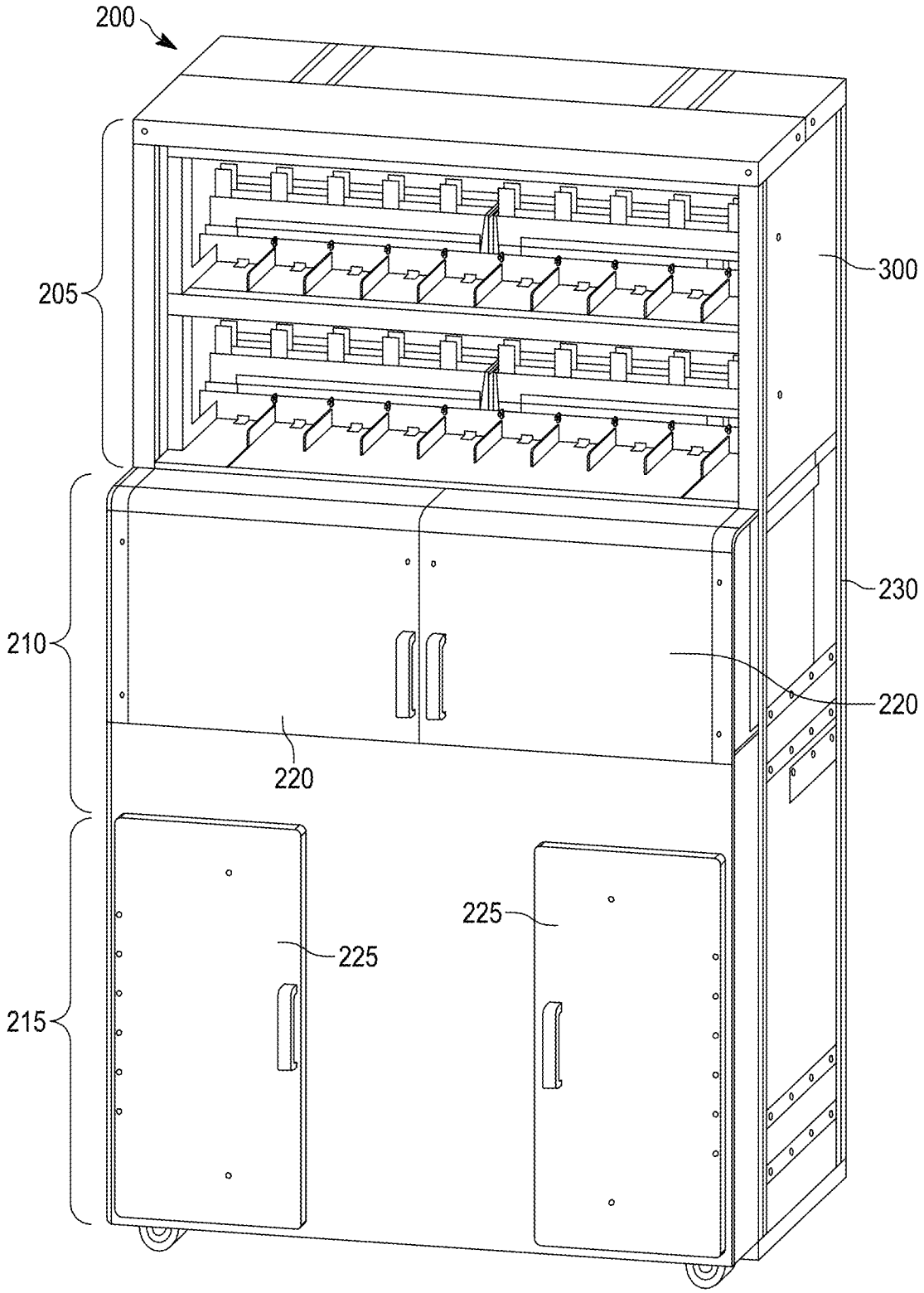
FIG. 3 is a perspective view of an automatic blister card packager in accordance with some examples.
Figure 4:
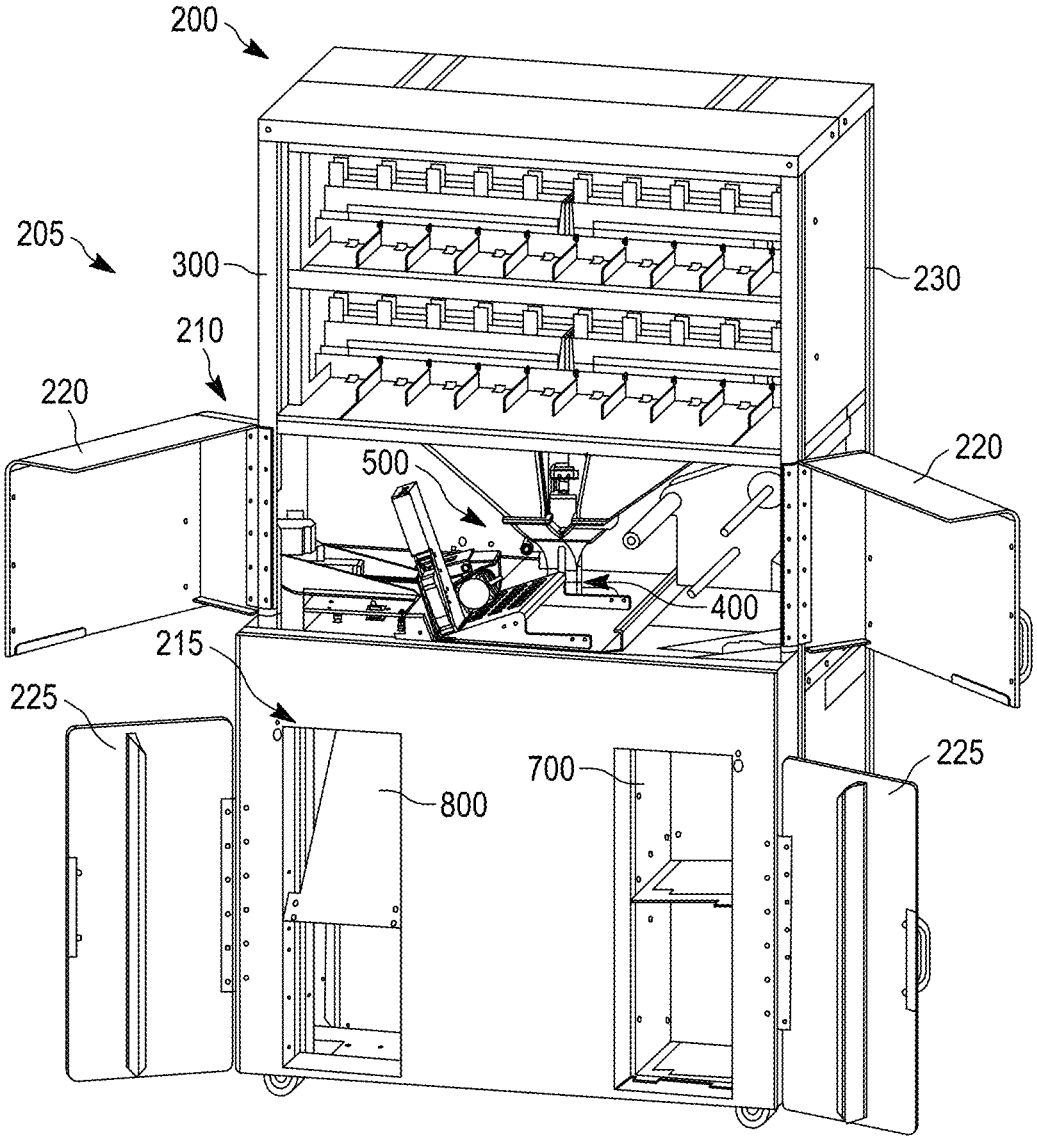
FIG. 4 is a perspective view of the automatic blister card packager of FIG. 3 with doors opened in accordance with some examples.

FIGS. 3-4 illustrate an example of an automatic blister card packager 200 that efficiently packages the blister cards 100. In the example illustrated, the automatic blister card packager 200 is divided into a cartridge section 205, a packaging section 210, and a card transfer section 215. The cartridge section 205 is provided above the packaging section 210 to dispense pharmaceuticals to the packaging section 210. The packaging section 210 is provided above the card transfer section 215 and may overlap the card transfer section 215. The cartridge section 205 is provided above the card transfer section 215. In other examples, the location or arrangement of the cartridge section 205, the packaging section 210, and the card transfer section 215 may vary.

In one example, the cartridge section 205 is open while packaging section doors 220 are provided for the packaging section 210 and card transfer doors 225 are provided for the card transfer section 215. The packaging section doors 220 open outwards to expose at least portions of the packaging section 210. The packaging section doors 220 may be closed during operation to inhibit contaminants from getting into the blister card 100. The packaging section doors 220 may be opened to allow for a user or technician to clean or inspect the packaging section 210. The card transfer doors 225 may similarly open outwards to expose at least portions of the card transfer section 215. In some examples, a single door may be provided to access one or more of the cartridge section 205, the packaging section 210, and the card transfer section 215. In other example, each of the cartridge section 205, the packaging section 210, and the card transfer section 215 may be open without any doors for selective access.

The cartridge section 205, the packaging section 210, and the card transfer section 215 may together form the frame or housing 230 of the automatic blister card packager 200 to which the various components disclosed below are mounted on or housed in. The frame or housing 230 may be made of rigid material, for example, metal, carbon fiber, or the like to provide support for the various components.

Figure 5:
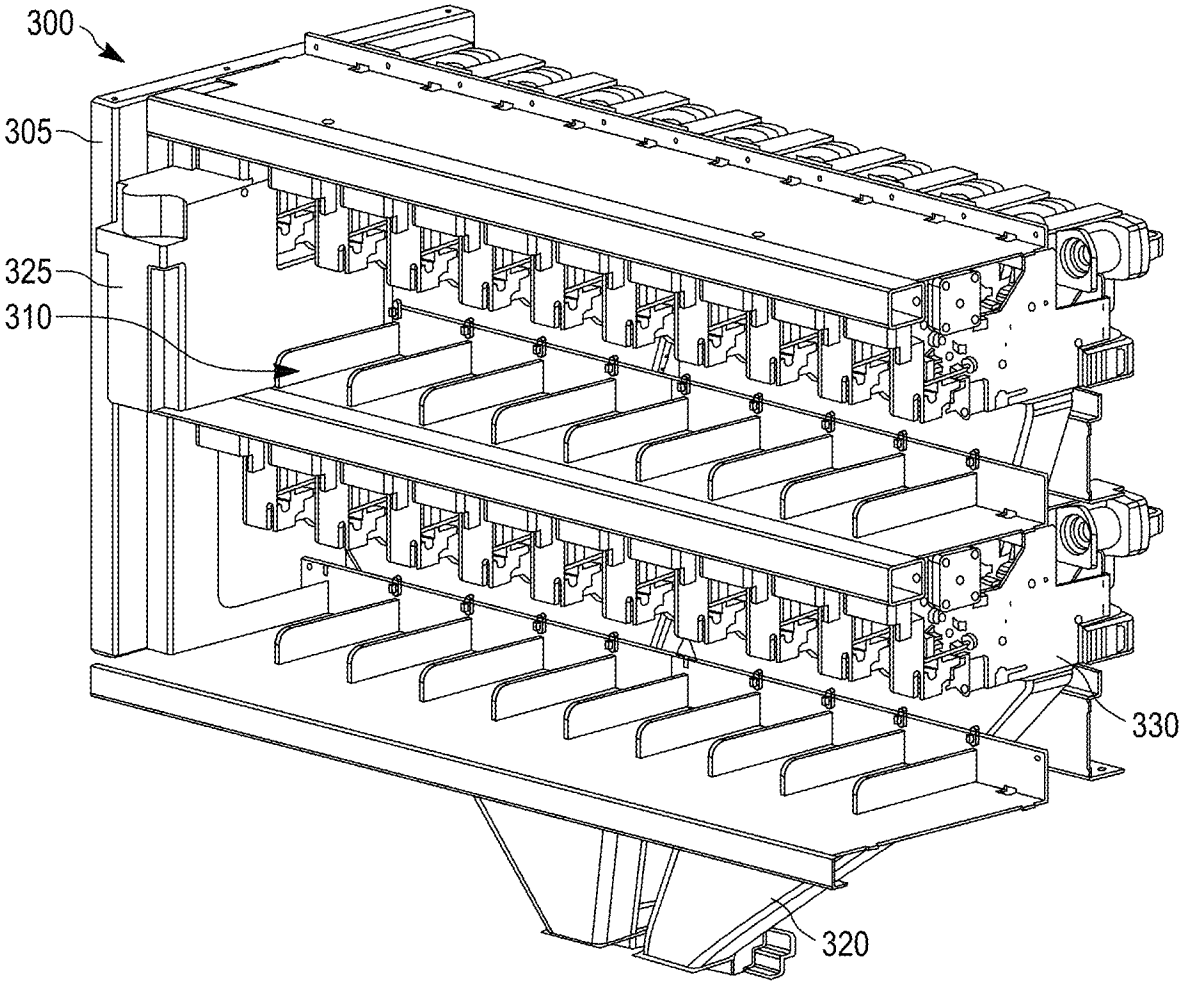
FIG. 5 is a front perspective view of a universal feed cassette of the automatic blister card packager of FIG. 3 with a part of a housing removed in accordance with some examples.
Figure 6:
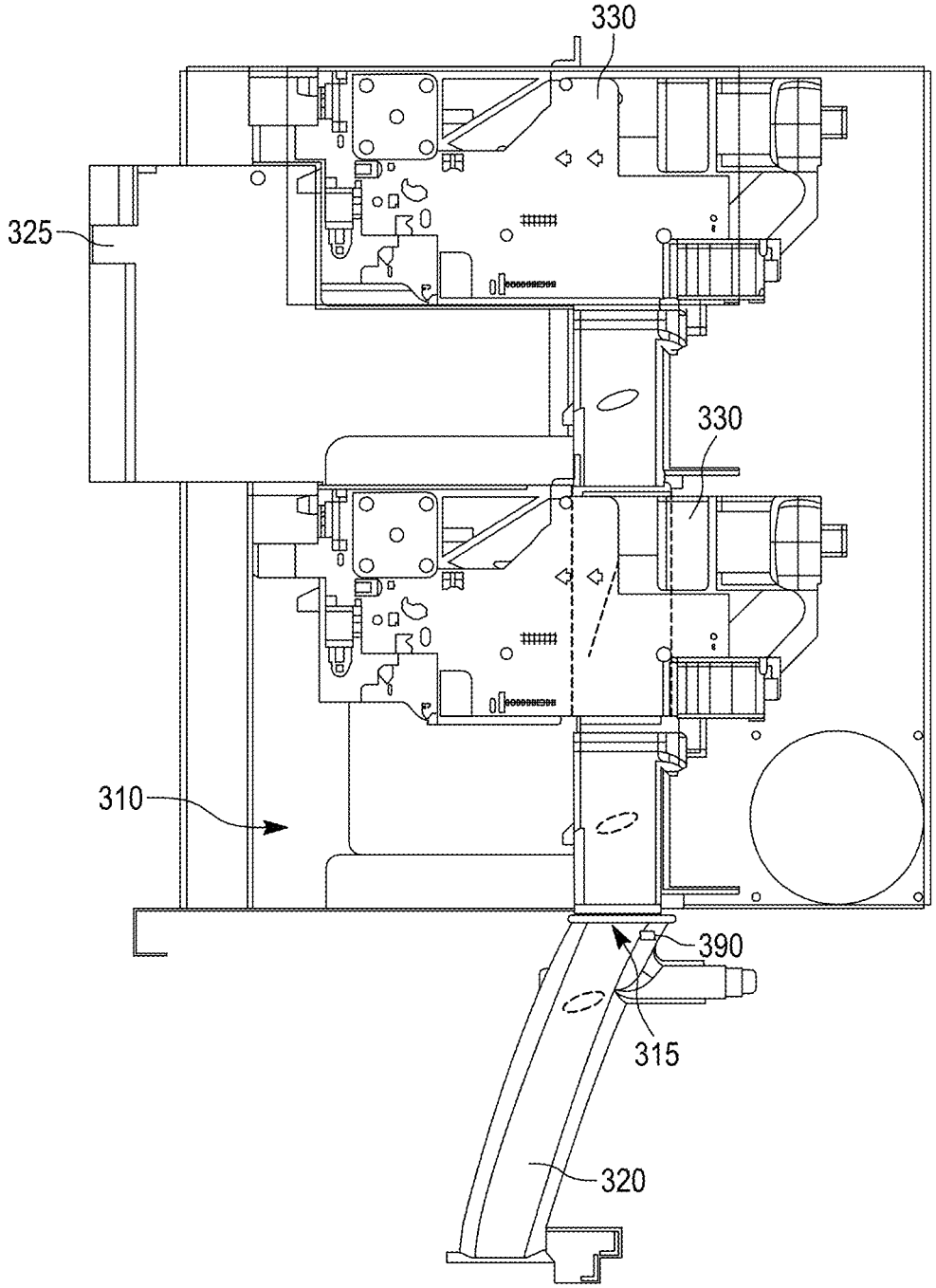
FIG. 6 is a plan view of the universal feed cassette of FIG. 5 in accordance with some examples.

The cartridge section 205 includes a universal feed cassette 300 supported by the frame or housing 230. The universal feed cassette 300 receives medications from the bulk canisters and individually dispenses pills to the packaging section 210. Referring to FIGS. 5-6, the universal feed cassette 300 includes a cassette housing 305 having a plurality of cartridge slots 310 within the cassette housing 305. Dispensing openings 315 are provided on the bottom of the cassette housing 305. The dispensing openings 315 are in communication with a chute 320 of the automatic blister card packager 200. The chute 320 may be provided in the packaging section 210 of the automatic blister card packager 200. In the example illustrated in FIGS. 5-6, the universal feed cassette 300 includes up to sixteen cartridge slots 310. In some examples, the cartridge slots 310 are arranged in a duplex-formation (e.g., two vertically stacked rows) such that a second row of cartridge slots 310 are provided above a first row of cartridge slots 310 within the cassette housing 305 to facilitate faster filling of blister cards 100. In some examples, the cartridge slots 310 may be provided directly on the packaging section 210 without a universal feed cassette 300 or without a cassette housing 305.

FIG. 6 illustrates a side-profile view of the duplex-formation of the cartridge slots 310. In some examples, the universal feed cassette 300 may only include a single row of cartridge slots 310, or may include more than two rows of cartridge slots 310. The cartridge slots 310 are configured to receive cartridges 325. A plurality of cartridge mechanisms 330, one for each cartridge slot 310 is fixed to the cassette housing 305. When received in the cartridge slots 310, the cartridges 325 are connected to the cartridge mechanism 330. The cartridge mechanism 330 individually dispenses medications from the cartridge 325 as described below. The dispensing openings 315 transfer the medications from the cartridges 325 to the packaging section 210 for packaging.

Figure 7:
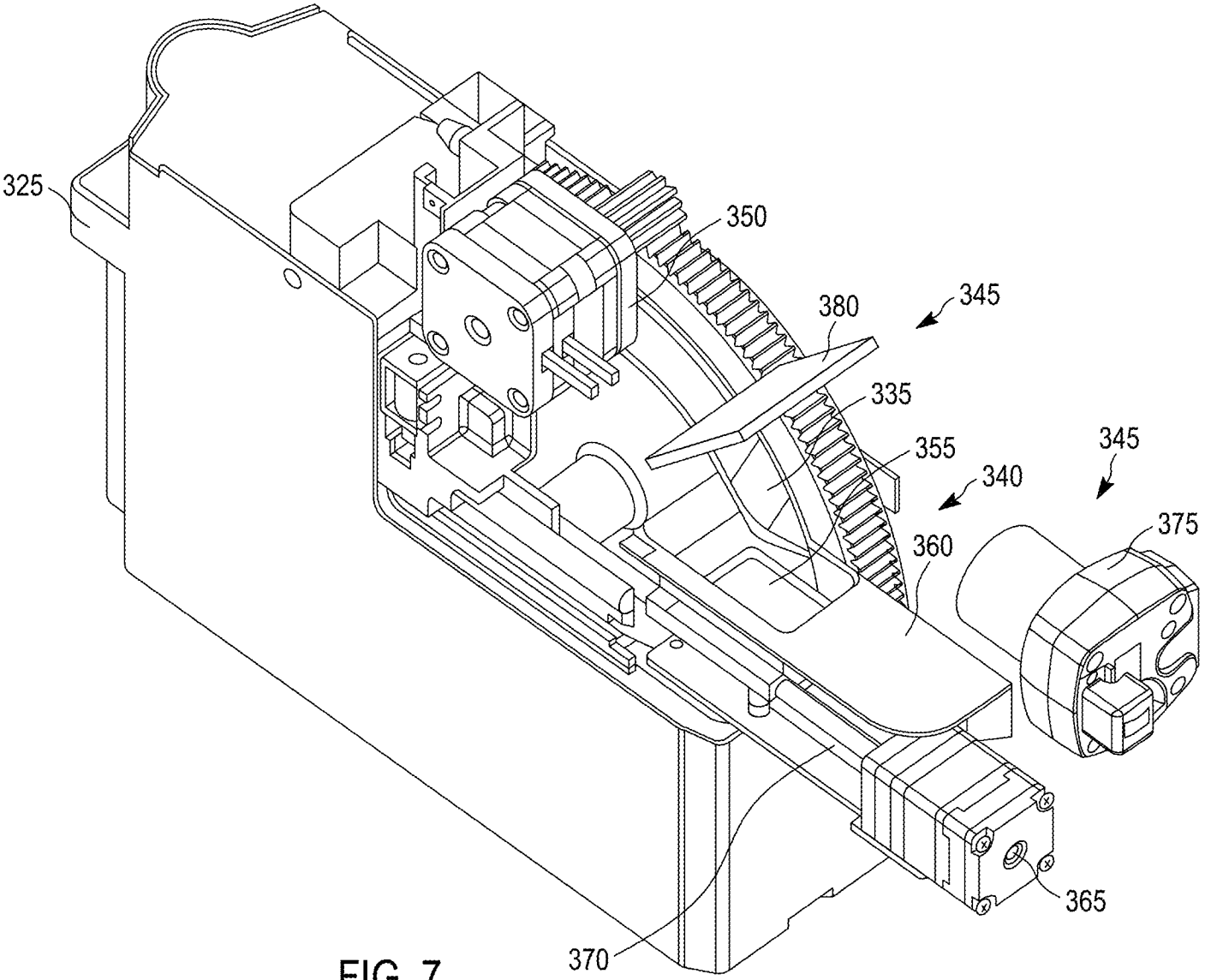
FIG. 7 is a perspective view of the cartridge and the cartridge mechanism of the universal feed cassette of FIG. 5 in accordance with some examples.

Referring to FIG. 7, the cartridge 325 stores medications during the dispensing process and includes a wheel 335 to transport the medications to the cartridge mechanism 330. The cartridge mechanism 330 includes a shuttle system 340, a camera system 345, and a motor assembly 350. The wheel 335 is driven by the motor assembly 350. When the wheel 335 is driven, the wheel 335 singulates medications stored in the cartridge 325 and delivers the singulated medications to the shuttle system 340. The shuttle system 340 includes a platform 355, a shuttle 360, and a shuttle drive 365. The platform 355 may be made from a clear or translucent plastic material. An LED lighting system may be provided over and/or under the platform 355 to illuminate the contents on the platform 355 when the camera system 345 is capturing an image of the contents. The LED lighting system may emit visible or infrared light to illuminate the platform 355.

The shuttle 360 may be moved laterally between the platform 355, over a medication reservoir of the cartridge 325, and over a conduit 370. The shuttle 360 transfers the medications from the platform 355 either back to the cartridge 325 or to the conduit 370. The shuttle 360 is driven by the shuttle drive 365. The shuttle drive 365 may be a motor assembly, an actuator, or the like. In some examples, a different system or mechanism than described above may be used to singulate medications and deliver medications individually to the packaging section 210.

The camera system 345 includes a camera 375 and a mirror 380. The camera 375 is positioned at the back of the cartridge mechanism 330. The camera 375 may be a still camera or a video camera that captures an image of the contents of the platform. The mirror 380 is placed directly above the platform 355 and is tilted at a 45-degree angle such that the camera 375 positioned at the back of the cartridge mechanism 330 can capture an image of the platform 355. In other examples, the camera 375 may be placed directly above the platform or in other configurations with or without using the mirror 380. The camera system 345 allows for a first verification of the blister card filling process. Specifically, the camera system 345 is used to verify that the correct number and/or type of medications are being dispensed from the cartridges 325.

Figure 8:
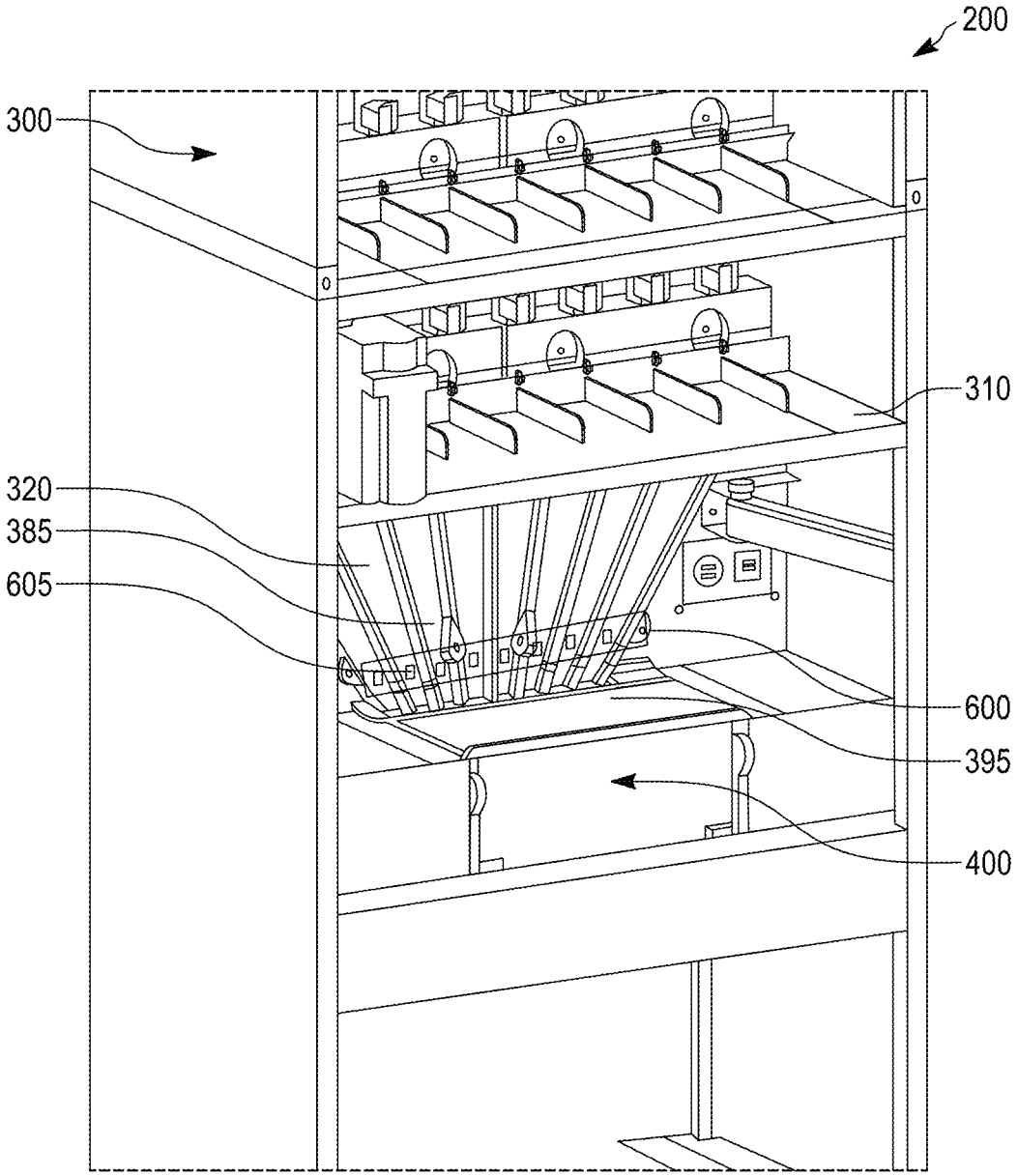
FIG. 8 is an enlarged view of a portion of the automatic blister card packager of FIG. 3 in accordance with some examples.

FIG. 8 illustrates one example of the chute 320 for use with the automatic blister card packager 200. The chute 320 helps direct pharmaceuticals (e.g., pills, vitamins, etc.) from the universal feed cassette 300 to a filling station 400 provided in the packaging section 210. In the illustrated example, the chute 320 includes eight separate channels or tracks 385. The number of tracks 385 correspond to the number of cartridge slots 310 (and thereby cartridges 325) in each row of the universal feed cassette 300. As such, in some examples, the chute 320 may include fewer or more tracks 385. Each track 385 has a separate outlet that corresponds to one of the blister openings 435 (shown in FIG. 11) in a platen 410. When pharmaceuticals are delivered from the universal feed cassette 300, the pharmaceuticals travel through the tracks 385, through the outlets, and into one of the blister openings 435 in the platen 410.

Using the chute 320, the cartridges 325 may simultaneously (or relatively simultaneously) release pills to fill a row (or a column) of the blister compartments 120, the platen 410 may index to the next row (or the next column) of the blister compartments 120 along an axis, and the process may repeat until all of the rows (or columns) of the blister compartments 120 are filled. In some examples, the cartridges 325 may release a single pill into each of the blister compartments 120. In other examples, the cartridges 325 may release multiple pills into each of the blister compartments 120 (e.g., between two and eight pills, depending on the size of the blister compartment 120).

Figure 9:
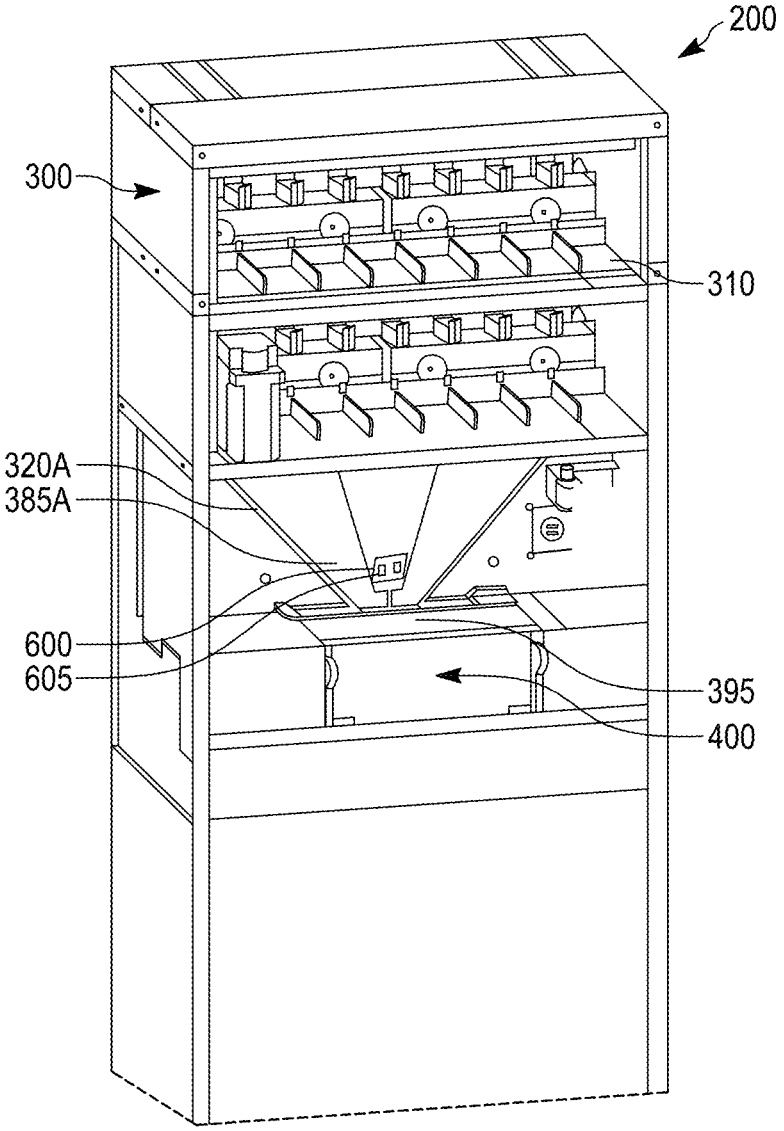
FIG. 9 is a perspective view of the automatic blister card packager of FIG. 3 in accordance with some examples.

FIG. 9 illustrates another example of a chute 320A for use with the automatic blister card packager 200. In the illustrated example, the chute 320A includes two shared channels or tracks 385A that dispense pharmaceuticals through shared outlets to the platen 410. For example, four cartridge slots 310 (and thereby cartridges 325) in one row of the universal feed cassette 300 share one half of the chute 320A (that is, a first track 385A) to dispense pharmaceuticals through a first outlet, while four other cartridge slots 310 (and thereby cartridges 325) in the same row of the universal feed cassette 300 share the other half of the chute 320A (that is, a second track 385A) to dispense pharmaceuticals through a second outlet. In other examples, the chute 320A may include a single shared track or channel that dispenses pharmaceuticals through a single outlet. The illustrated example of the chute 320A, therefore, can only direct pharmaceuticals to two blister openings 435 (shown in FIG. 11) of the platen 410 at a time. The platen 410, however, can move side-to-side to align with different blister openings 435 in a row of blister openings 435 with the shared outlets of the chute 320A.

Using the chute 320A, only two of the cartridges 325 (e.g., one of the cartridges 325 associated with each shared track 385A) may release medications. The medications are then delivered by the shared outlets into the associated ones of the blister compartments 120 of the blister card 100. After the associated ones of the blister compartments 120 in a row are filled, the platen 410 may then move along a first axis (e.g., the x-axis) to fill additional blister compartments 120 in the row. Once a complete row of blister compartments 120 is filled, the platen 410 may index to the next row of blister compartments 120 along a second axis (e.g., the y-axis), and the process may repeat. Such a process may be used to deliver a single medication to each blister compartment 120 of the blister card 100. Alternatively, multiple medications may be delivered to each blister compartment 120 of the blister card 100. For example, more than one cartridge 325 associated with each shared track 385A may simultaneously (or relatively simultaneously) release a pill into the shared track 385A to deliver multiple pills to a single blister compartment 120. Alternatively, each cartridge 325 may release more than one pill into the shared track 385A. In some examples, a complete row of blister compartments 120 may not be filled before the platen 410 moves on to the next row. Rather, the platen 410 may "zig-zag" along the first and second axes to fill the blister compartments 120. Hereinafter, chute 320 may refer to either of the configurations illustrated in FIGS. 8 and 9 or other similar configurations.

Referring to FIG. 6, cameras 390 are mounted at or near the junction of the conduits 370 and the chute 320. Each camera 390 is associated with one of the cartridges 325 supported in the universal feed cassette 300. The cameras 390 are operable to capture images and determine whether the proper number and/or type of medications are being dispensed from the cartridges 325. The cameras 390 capture images of pharmaceuticals exiting the universal feed cassette 300 and compare features (e.g., color, contour, size, shape, inscription, etc.) of the pharmaceuticals to stored images of known pharmaceuticals. In some examples, recognition software may be employed to automatically compare the images captured by the cameras 390 to stored images. In other examples, the captured images may be transmitted to a remotely located pharmacist or technician who analyzes the images and verifies that the correct number and type of pharmaceuticals were dispensed. In further examples, pill sensor (e.g., infrared sensors, optical sensors, etc.) at or near the junction of the conduits 370 and the chute 320 may be used instead of the cameras 390 to only detect whether an object (e.g., a pill) drops through the universal feed cassette 300, rather than identifying the particular type of pharmaceutical. The cameras 390 provide a second optional verification of whether a correct type and/or number of medications are being delivered to the blister card 100.

Figure 10:
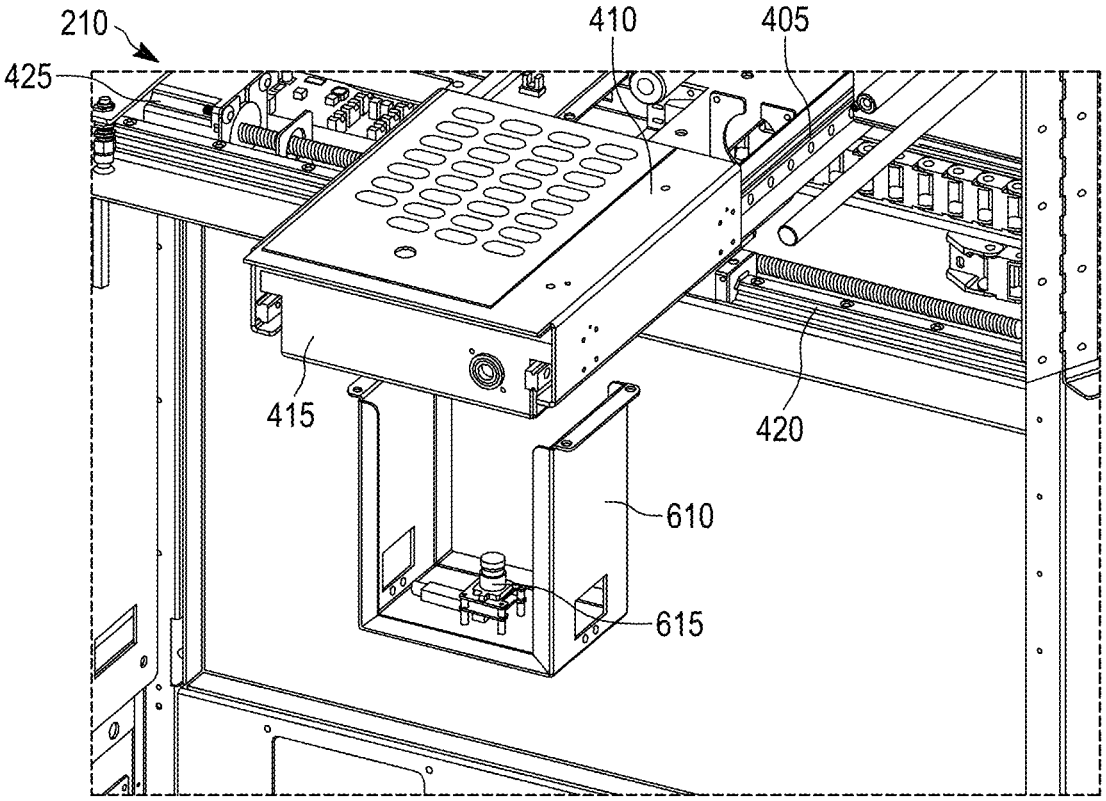
FIG. 10 is an enlarged view of a portion of the automatic blister card packager of FIG. 3 showing a platen in accordance with some examples.

Referring to FIG. 8-9, the packaging section 210 includes a filling station 400 to package the medications dispensed from the universal feed cassette 300 into the blister card 100. The filling station 400 refers to the area near the bottom of the chute 320 where the medications are delivered to be packaged into the blister card 100. Referring to FIG. 10, the packaging section 210 includes a first rail system 405 and a platen 410. The first rail system 405 includes a first rail drive 415 and moves the platen 410 along a first axis of the automatic blister card packager 200 (e.g., a front-back axis). The first rail system 405 telescopes the platen 410 along the length of the filling station 400. The first rail drive 415 may be a motor assembly, an actuator, or the like that drives the platen 410 using the first rail system 405. In other example, a different moving system may be used to translate the platen 410 along the length of the filling station 400.

The packaging section 210 also includes a second rail system 420. The second rail system 420 includes a second rail drive 425 and moves the platen 410 and the first rail system 405 along a second axis of the automatic blister card packager 200. The second rail system 420 and the second rail drive 425 may work similarly as the first rail system 405 and the first rail drive 415 to move the platen 410 and the first rail system 405 along a second axis (e.g., a left-right axis). Alternatively, in some examples, the second rail system 420 moves the platen 410 and the first rail system 405 drives the platen 410 and the second rail system 420. In yet other examples, different drive configurations may be used to move the platen 410 within the automatic blister card packager 200.

Figure 11:
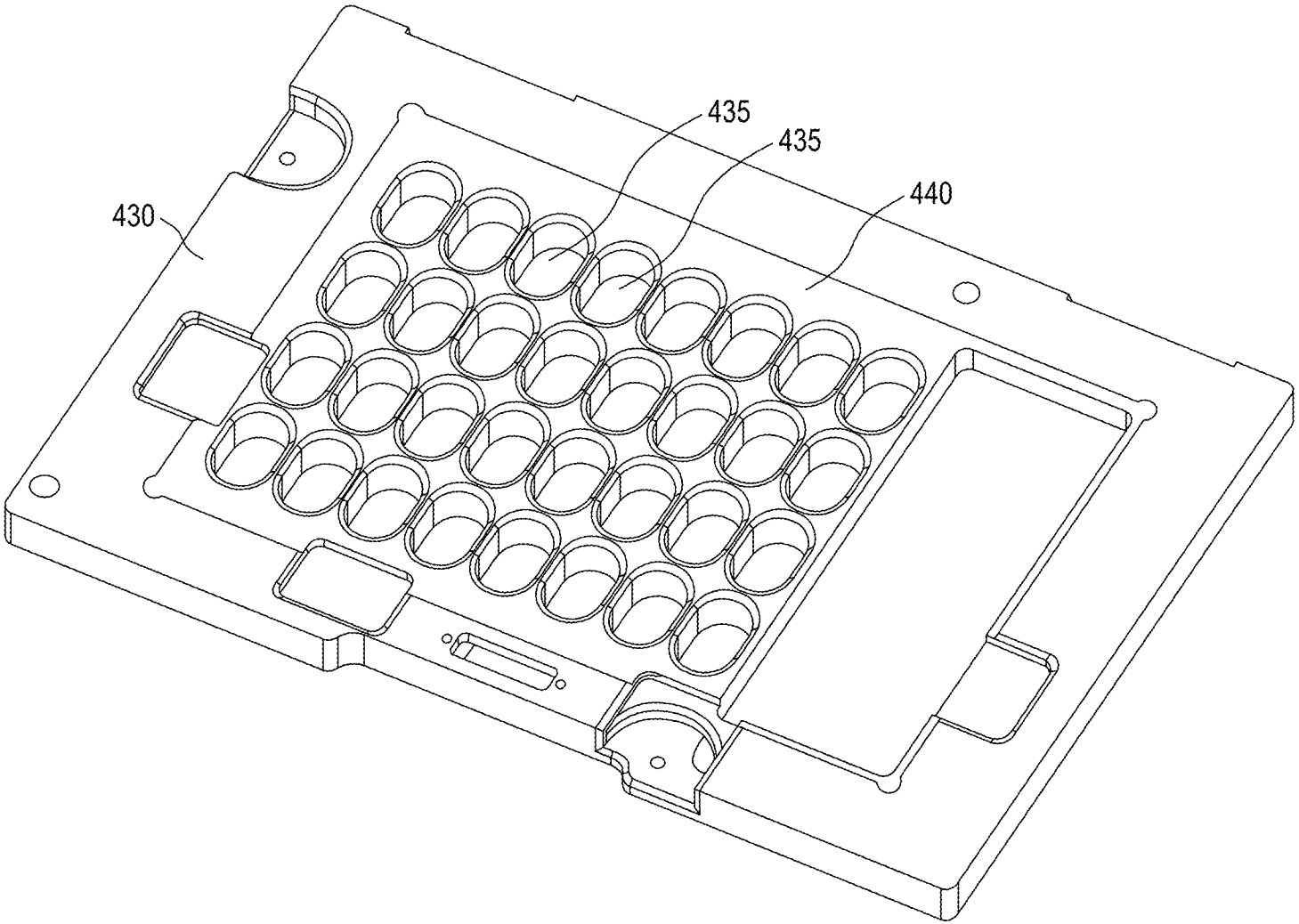
FIG. 11 is a perspective view of a packaging plate of the platen of FIG. 10 in accordance with some examples.

Referring to FIG. 11, the platen 410 includes a packaging plate 430. The packaging plate 430 includes blister openings 435 provided in a blister card receiving portion 440. The blister openings 435 accommodate the blister compartments 120 of the blister sheet 110. In the example illustrated, the blister openings 435 are through-holes that extend through the packaging plate 430.

Referring to FIGS. 8-9, a filling cover 395 may be attached to the outlets of the chute 320 in some example implementations. The filling cover 395 covers one or more of the blister compartments 120 that are not directly under the outlets of the chute 320. For example, the filling cover 395 may include a number of openings corresponding to the outlets of the chute 320 to allow the medications to pass through from the chute 320 to the blister compartments 120 under the outlets of the chute 320. The filling cover 395 prevents medications from hopping from one blister compartment 120 to another during the filling process by providing a barrier between the blister compartments 120 being filled and the remaining blister compartments 120. In one example, the filling cover 395 is dimensioned larger than the size of the blister card 100 to account for the X-Y axis movement of the platen 410 (e.g., two times larger to cover only X-axis or only Y-axis movement, four times larger to cover both X-Y axis movement, or the like). In one example, the filling cover 395 is dimensioned to be the same size or smaller than the blister card 10. For example, the filling cover 395 may extend to only one side, e.g., towards a side of movement of the platen 410 along an X-axis or Y-axis.

Figure 12A:
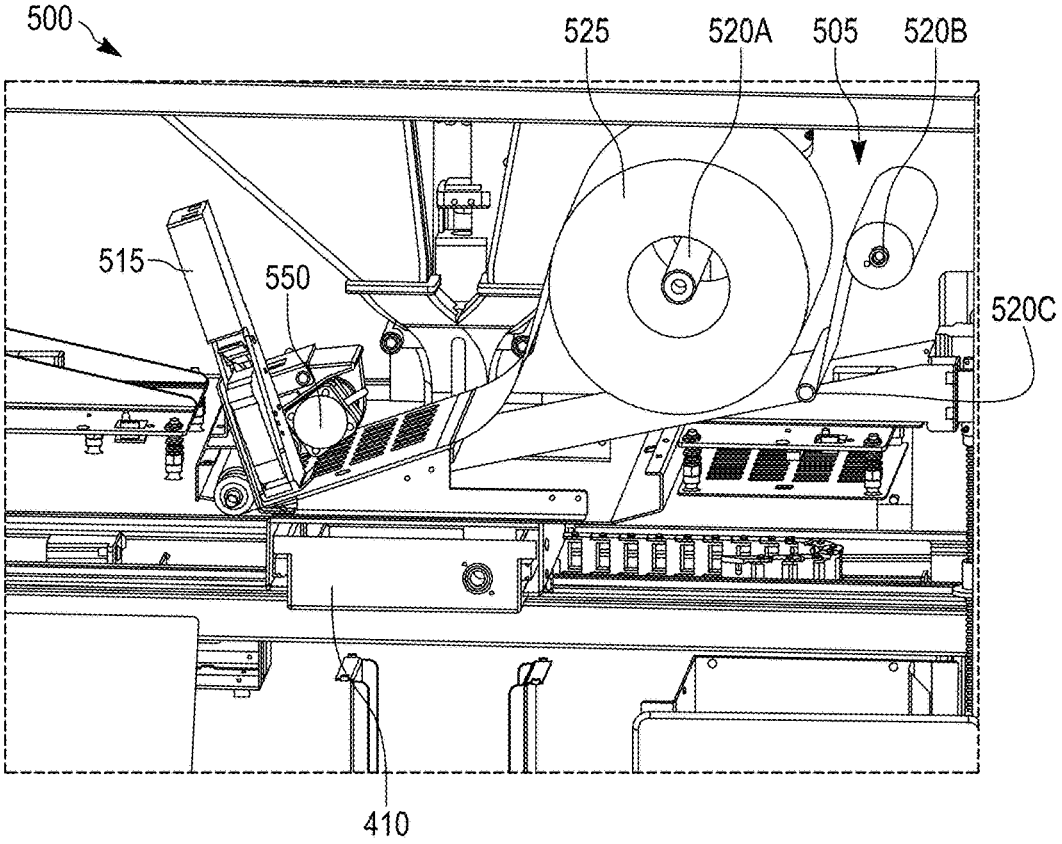
FIG. 12A is an enlarged view of a portion of the automatic blister card packager of FIG. 3 showing a front perspective view of a sealing assembly in accordance with some examples.
Figure 12B:
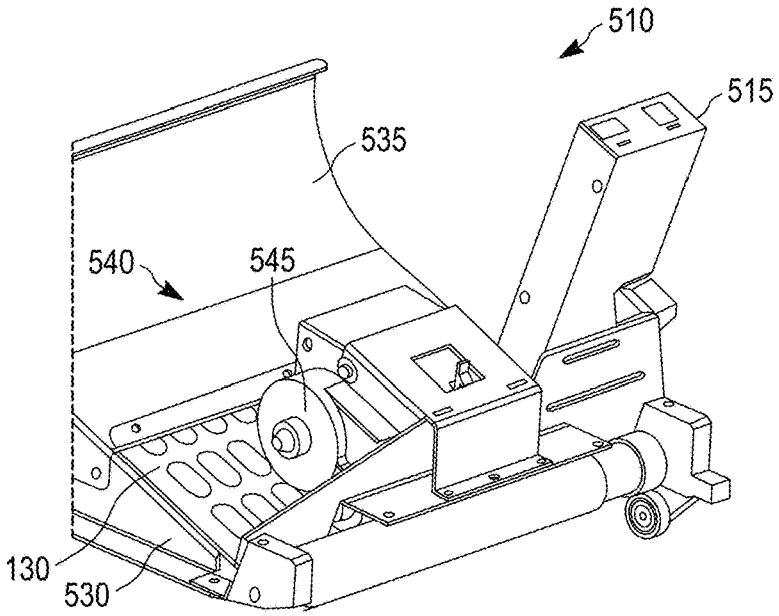
FIG. 12B is a rear perspective view of the sealing assembly of FIG. 12A in accordance with some examples.

Referring to FIGS. 12A-12B, the packaging section 210 also includes a sealing assembly 500. The sealing assembly 500 includes a lid roll holder assembly 505, a guider assembly 510, and a print roller 515. The lid roll holder assembly 505 may include a plurality of holders 520 that support and guide a lid roll 525 through the sealing assembly 500. In the example illustrated, the plurality of holders 520 include a feed holder 520A, a take-up holder 520B, and a guide holder 520C. In some examples, the number or type of holders 520 may differ. The feed holder 520A may be used to hold the unspent lid roll 525 that is fed to the guider assembly 510. The take-up holder 520B may be used to take-up the spent lid roll 525 after the lids 130 are peeled from the lid roll 525. The guide holder 520C may be used to guide the lid roll 525 through the packaging section 210 around the feed holder 520A or the take-up holder 520B.

The guider assembly 510 includes a base 530, a guider 535 fixed to the base 530, and a traction assembly 540 fixed to the base 530. The guider assembly 510 routes or guides the lid 130 from the feed holder 520A to the print roller 515. In the example illustrated, the base 530 includes side portions that are fixed to the automatic blister card packager 200. The base 530 also includes an incline portion that is integrated with the side portions. The incline portion extends downward (i.e., declines) from the guider 535 to the print roller 515 and guides the lid 130 from the feed holder 520A that may be provided above the sealing assembly 500 to the print roller 515. The incline portion includes an edge at a bottom of the incline such that the lid roll 525 is routed around the edge to be returned to the take-up holder 520B. The guider 535 may be fixed at a top of the inclined portion and includes a curved surface that guides the lid roll 525 from the feed holder 520A to the base 530 (e.g., the incline portion of the base 530). The guider assembly 510 may include a different structure than described above. For example, either of the base 530 or the guider 535 may be removed or structured differently.

The traction assembly 540 includes a traction roller 545 controlled by a traction motor 550. The lid 130 may be routed between the traction roller 545 and the incline portion of the base 530. The traction roller 545 may be provided near (e.g., adjacent) the bottom edge of the incline portion. The traction roller 545 may include a rubber, silicone, or like surface to create a traction (e.g., gripping) between the traction roller 545 and the lid 130. The traction roller 545 is rotated using the traction motor 550.

The sealing assembly 500 may include a vision system, for example, an optical sensor, a camera, or the like that detects an edge of the lid 130. The vision system may be used to line up the lid 130 with the blister card 100 on the platen 410. In one example, the action of rolling the lid roll 525 around the edge results in a peeling of a lid 130 from the lid roll 525. As the vision system detects the lid 130 lining up with the blister card 100 on the platen 410, the traction motor 550 may be controlled to rotate the traction roller 545 at the same time as the lid roll holder assembly 505 to peel the lid 130 from the lid roll 525. For example, providing a sharp turn using the incline portion and the traction roller 545 gripping the lid 130 (e.g., through traction) may result in a lid 130 being peeled from the lid roll 525 without needing a separate peeler. In other examples, a separate peeler may be used to peel the lid 130 from the lid roll 525. The print roller 515 is provided above the platen 410 and applies the lid 130 to the blister card 100 as the platen 410 moves under the print roller 515. The print roller 515 may be fixed to the guider assembly 510. The print roller 515 may apply a pressure on the lid 130 to activate the adhesive on the lid 130. The print roller 515 also prints information on the lid 130 at the same time (i.e., simultaneously) as the lid 130 is being applied to the blister card 100 on the platen 410. For example, the print roller 515 prints information after the lid 130 is started to be applied to the blister card 100 but before the lid 130 is completely off the lid roll 525.

Referring to FIG. 8, a first verification camera system 600 may be placed near the chute 320. The first verification camera system 600 may include a plurality of first verification cameras 605 placed near the junction of the chute 320 and the platen 410. The plurality of first verification cameras 605 can include one first verification camera 605 for each track of the chute 320. The first verification camera 605 for each track may be placed just above the junction of the chute 320 and the platen 410. The first verification camera 605 for each track is configured to capture an image of the blister compartment 120 corresponding to the track from above the blister compartment 120. For example, the first verification cameras 605 may be configured to capture an image of the blister compartment 120 looking through the openings in the filling cover 395. The first verification camera 605 may capture the images before and/or after one or more pills are released into the blister compartment 120. In some examples, the first verification camera system 600 and the corresponding plurality of first verification cameras 605 may be placed in other locations. In one example, the tracks of the chute 320 may curve backward toward the bottom end of the chute 320 to direct the medications into the blister compartments 120. The first verification camera system 600 may be provided just above the curved portion and behind the chute 320 such that the plurality of first verification cameras 605 have a view of the of the blister compartments 120 through the curved portions of the track. In some examples, the first verification camera system 600 may include more or fewer first verification cameras 605 than the number of tracks in the chute 320. In these examples, the first verification cameras 605 or the platen 410 may be moved to capture the images from above the blister compartments 120.

Referring to FIG. 9, the first verification camera system 600 may be placed near the chute 320A. In this example, the first verification camera system 600 may include two first verification cameras 605, one for each track 385A of the chute 320A. Alternatively, the first verification camera system 600 may include a single verification camera that has visibility to both tracks 385A. The tracks 385A include a curve near the bottom end of the chute 320A. The tracks 385A curve inward from the chute 320A. The first verification cameras 605 are placed near the junction of the chute 320A and the platen 410 and just above the curved portion of the tracks 385A such that the first verification cameras 605 have a view of the blister compartments 120 through the curved portions of the tracks 385A. The first verification cameras 605 are configured to capture an image of the blister compartment 120 corresponding to the track 385A from above the blister compartment 120. For example, the first verification cameras 605 may be configured to capture an image of the blister compartment 120 looking through the openings in the filling cover 395. The first verification cameras 605 may capture the images before and/or after one or more pills are released into the blister compartment 120. In some examples, the first verification camera system 600 and the corresponding plurality of first verification cameras 605 may be placed in other locations.

Referring to FIG. 10, a second verification camera system 610 may be placed in the automatic blister card packager 200 under the platen 410. The second verification camera system 610 may include one or more second verification cameras 615 configured to capture images of the blister compartments 120 from under the platen 410. The first verification camera system 600 and the second verification camera system 610 are therefore configured to capture images of the blister compartments 120 from the top and the bottom of the blister card 100 during and/or after filling of the blister card 100. In some examples, the second verification camera system 610 and the corresponding one or more second verification cameras 615 may be placed in other locations, for example, on an opposite side of platen 410.

In some examples, the first verification camera system 600 and the second verification camera system 610 may also include integrated lights (e.g., flashlights) to illuminate the blister compartments 120 when the images are taken. These lights may be activated when the cameras 605, 615 are capturing images of the blister compartments 120. In some examples, the first verification camera system 600 is configured to capture images of individual blister compartments 120 from above during filling, whereas the second verification camera system 610 is configured to capture an image of the filled blister card 100 as a whole from below after filling. In other examples, both the first verification camera system 600 and the second verification camera system 610 are configured to capture images of individual blister compartments 120, from above and below respectively, during filling. In still other examples, both the first verification camera system 600 and the second verification camera system 610 are configured to capture images of the blister card 100 as a whole from above and below. In still other examples, both the first verification camera system 600 and the second verification camera system 610 are configured to capture images of portions (for example, rows or columns) of the blister card 100 from above and below.

Referring to FIG. 4, the card transfer section 215 includes a loading station 700 and a discharging station 800. In the example illustrated, the loading station 700 is provided on a first side of the frame or housing 230 and the discharging station 800 is provided on a second side of the frame or housing 230. The second side is opposite the first side on the frame or housing 230. The loading station 700 and the discharging station 800 are provided partially or completely below the universal feed cassette 300 and the filling station 400.

Figure 14:
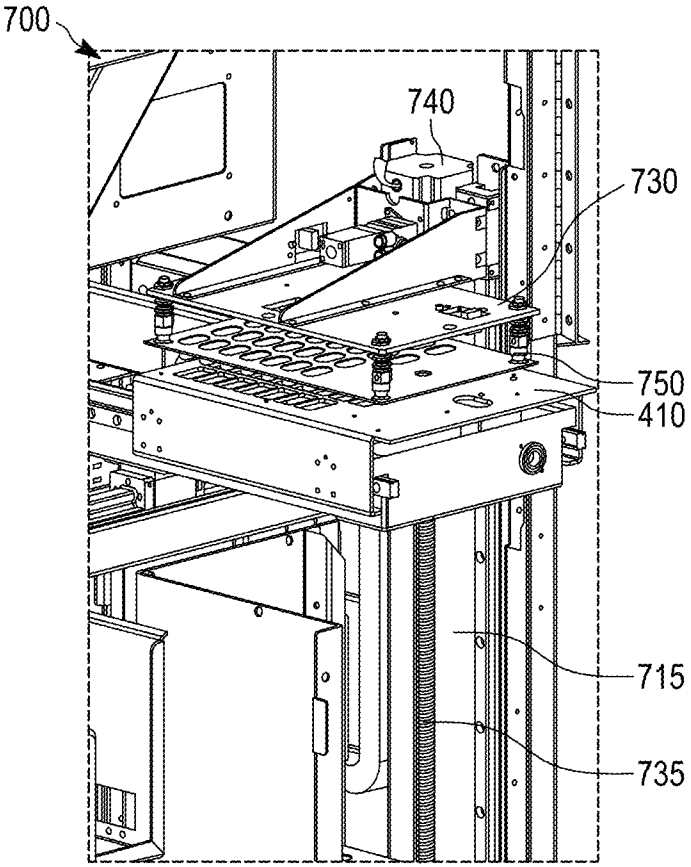
FIG. 14 is an enlarged view of a portion of the automatic blister card packager of FIG. 3 showing the loading station of FIG. 13 in accordance with some examples.
Figure 13:
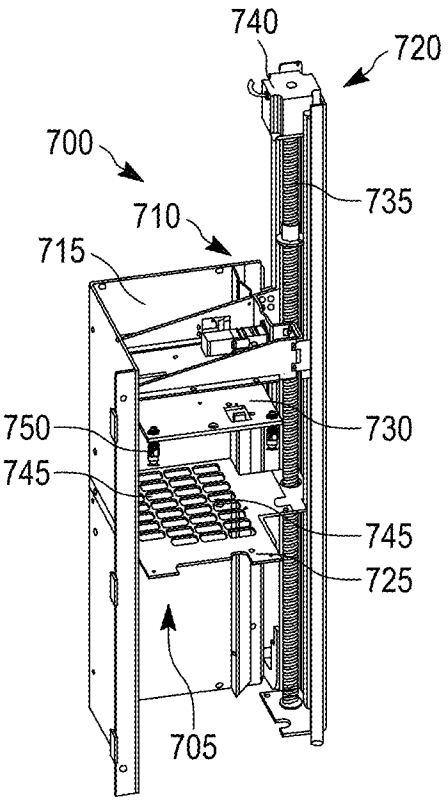
FIG. 13 is a perspective view of a loading station of the automatic blister card packager of FIG. 3 in accordance with some examples.

Referring to FIGS. 13-14, the loading station 700 includes a loading enclosure 705 and a card loading assembly 710 in the loading enclosure 705. In the example illustrated, the card loading assembly 710 includes a loader frame 715, a loader drive assembly 720, a card plate 725, and a loader plate 730. In the example illustrated, the loader frame 715 may be mounted to the frame or housing 230 or may be a part of the frame of housing 230. The loader drive assembly 720 is mounted to the loader frame 715. In the example illustrated, the loader drive assembly 720 includes a screw 735 driven by, for example, a motor 740. In other examples, the loader drive assembly 720 (e.g., base actuator) may include a different type of driving mechanism, for example, telescoping rails, or the like. In one example, the card plate 725 (base) is mounted to the screw 735 such that the card plate 725 moves along the screw 735 (e.g., track) as the screw 735 is driven by the motor 740. In another example, the card plate 725 is stationary and only the loader plate 730 is moved. In other examples, the card plate 725 may have a different configuration other than a plate and moves along a different track other than the screw (e.g., moves along rails). The card plate 725 is configured to receive a stack of blister cards 100 (e.g., a plurality of blister cards 100) and may include openings 745 to accommodate the blister compartment 120. One of the card transfer doors 225 may be used to cover the loading enclosure 705 during operation.

The loader plate 730 (e.g., a loader suction plate, a loader, etc.) is mounted to the screw 735 such that the loader plate 730 moves along the screw 735 (e.g., track) as the screw 735 is driven by the motor 740. The loader plate 730 may be driven to move along the loader frame 715 or the screw 735 along the same axis as the card plate 725. In one example, the loader plate 730 is driven by the loader drive assembly 720 (e.g., loader actuator). In another example, the loader plate 730 is driven by a separate drive assembly (e.g., loader actuator). The loader plate 730 includes one or more nozzles 750 that generate a suction force to grab a blister card 100 from the stack of the blister cards 100. The one or more nozzles 750 may also generate a positive pressure to push the blister card 100 from the loader plate 730. Positive pressure may refer to the opposite of suction force (that is, force generated in the opposite direction) generated by the suction system to, for example, blow air out of the one or more nozzles 750. In other examples, the loader plate 730 may have a different configuration other than a plate. Additionally or alternatively, in another example, the loader plate 730 may grab a blister card 100 from the stack of blister cards 100 using other suitable mechanisms, such as fingers, hooks, adhesives, magnets, static electricity, and the like. In such scenarios, the blister cards 100 may include appropriate features to interact with and be engaged by the loader plate 730.

Figure 16:
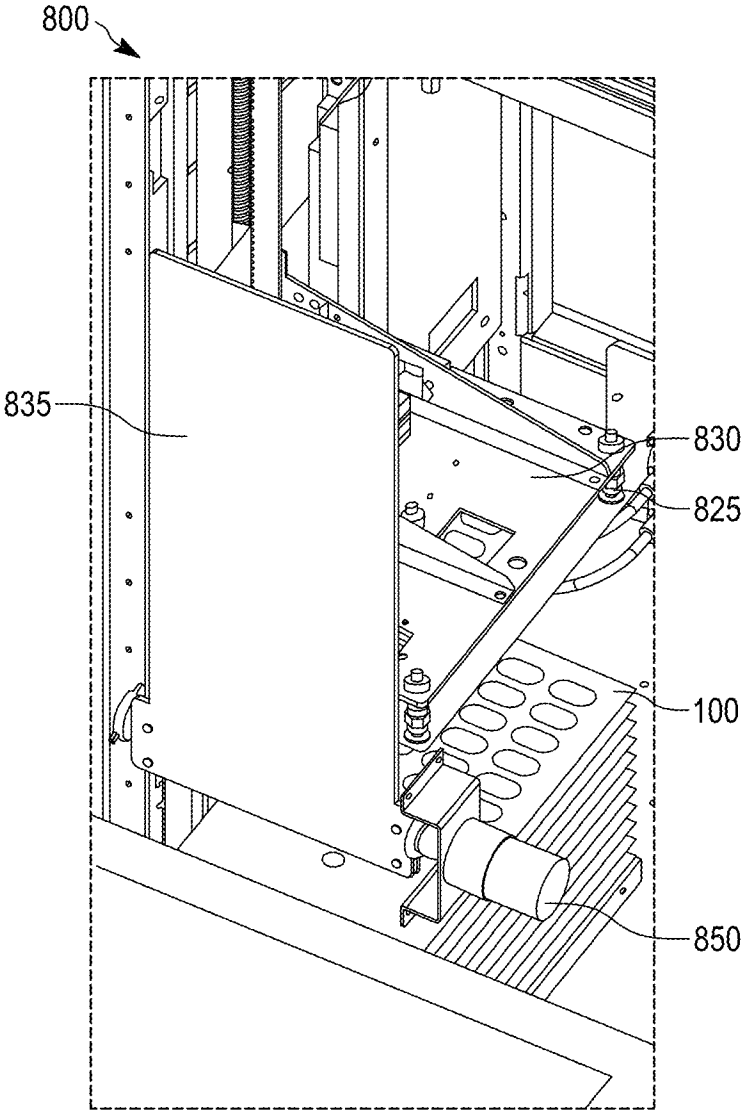
FIG. 16 is an enlarged view of a portion of the automatic blister card packager of FIG. 3 showing a discharging station in accordance with some examples.
Figure 15:
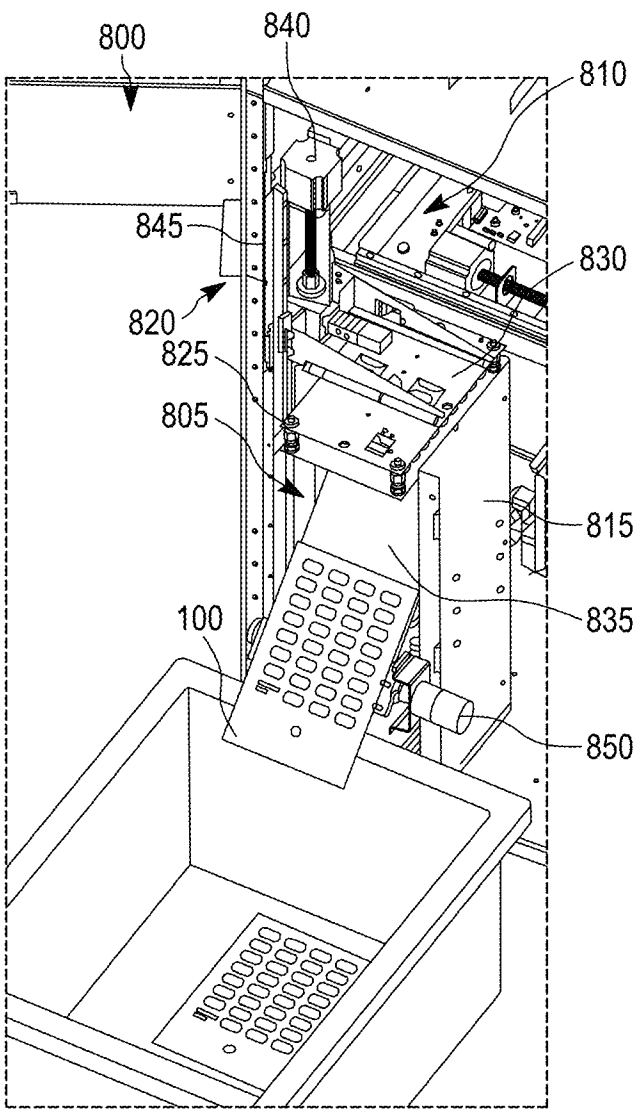
FIG. 15 is an enlarged view of a portion of the automatic blister card packager of FIG. 3 showing a discharging station in accordance with some examples.

Referring to FIGS. 15-16, the discharging station 800 includes a discharging enclosure 805 and a card discharging assembly 810 in the discharging enclosure 805. The card discharging assembly 810 includes a discharging frame 815, a discharger drive assembly 820, a discharger plate 830, and a deflector 835. In the example illustrated, the discharging frame 815 may be mounted to the frame or housing 230 or may be a part of the frame of housing 230. The discharger drive assembly 820 is mounted to the discharging frame 815. In the example illustrated, the discharger drive assembly 820 includes a screw 845 driven by, for example, a motor 840. In other examples, the discharger drive assembly 820 may include a different type of driving mechanism, for example, telescoping rails, or the like.

The discharger plate 830 (e.g., discharger) is mounted to the screw 845. The discharger plate 830 may also be driven to move along the discharging frame 815 or the screw 845. The discharger plate 830 may be driven by the discharger drive assembly 820 along the screw 845. The discharger plate 830 includes one or more nozzles 825 that generate a suction force to grab a blister card 100 from the platen 410. The one or more nozzles 825 (that is, the suction system through the one or more nozzles 825) may also generate a positive pressure to push the blister card 100 from the discharger plate 830. In other examples, the discharger plate 830 may have a different configuration other than a plate. Additionally or alternatively, in another example, the discharger plate 830 may grab a bister card 100 from the platen 410 using other suitable mechanisms, such as fingers, hooks, adhesives, magnets, static electricity, and the like. The deflector 835 is pivotably fixed to the frame or housing 230 and is pivoted by, for example, a deflector motor 850. The deflector motor 850 pivots the deflector 835 between a first position (shown in FIG. 15) and a second position (shown in FIG. 16). When in the first position as shown in FIG. 15, the deflector 835 extends into the discharging enclosure 805 to block the path of a filled blister card 100 when released from the discharger plate 830. When in the second position as shown in FIG. 16, the deflector 835 is out of the discharging enclosure 805 such that a filled blister card 100 when released from the discharger plate 830 falls straight down in the discharging enclosure 805.

Figure 17:
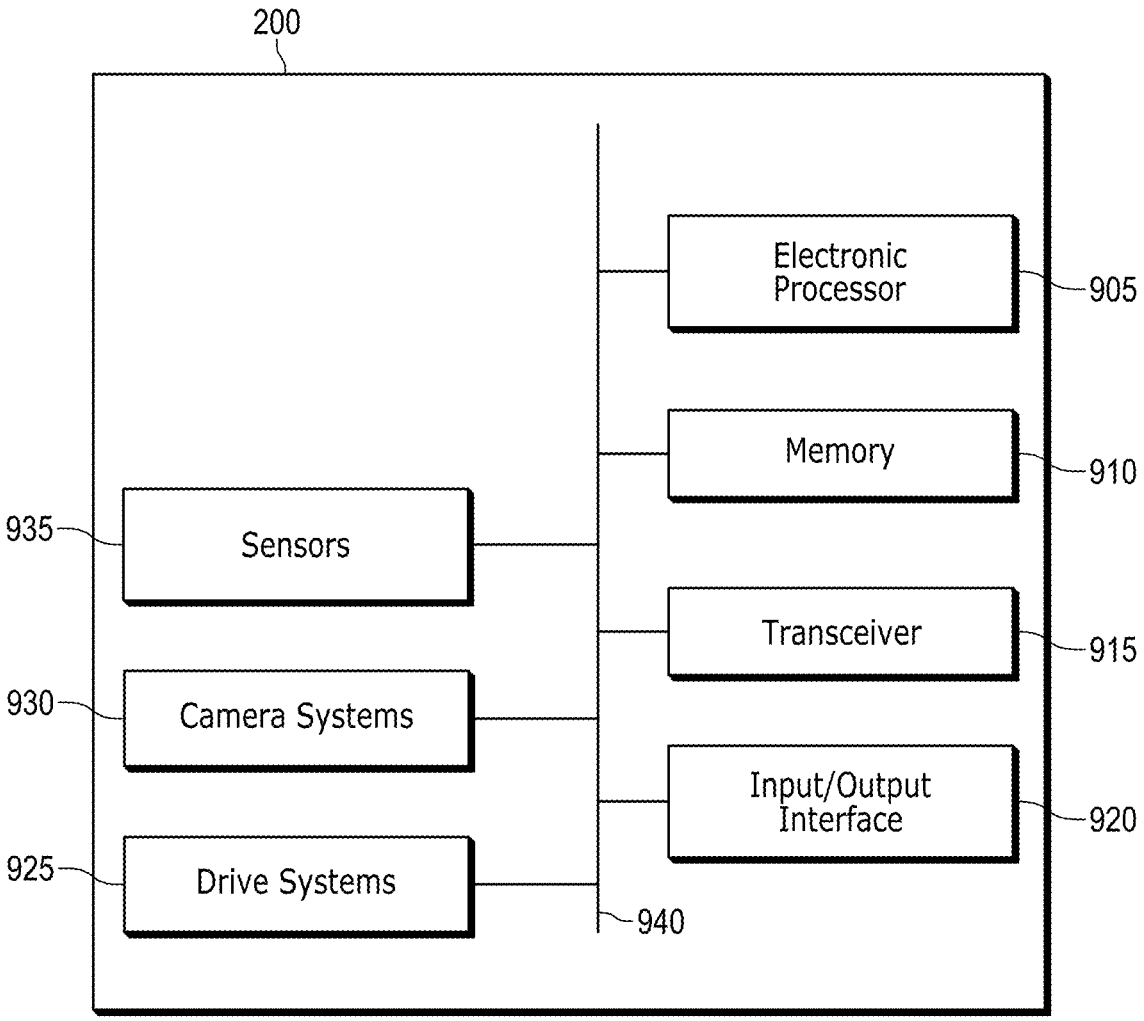
FIG. 17 is a block diagram of the automatic blister card packager of FIG. 3 in accordance with some examples.

FIG. 17 is a block diagram of an example automatic blister card packager 200. In the example illustrated, the automatic blister card packager 200 includes an electronic processor 905, a memory 910, a transceiver 915, and input/output interface 920, drive systems 925, camera systems 930, and sensors 935. The electronic processor 905, the memory 910, the transceiver 915, the input/output interface 920, the drive systems 925, the camera systems 930, and the sensors 935 communicate over one or more control and/or data buses (e.g., a communication bus 940). The automatic blister card packager 200 may include more or fewer components than those illustrated in FIG. 17.

In some examples, the electronic processor 905 is implemented as a microprocessor with separate memory, such as the memory 910. In other examples, the electronic processor 905 may be implemented as a microcontroller (with the memory 910 on the same chip). In other examples, the electronic processor 905 may be implemented using multiple processors. In addition, the electronic processor 905 may be implemented partially or entirely as, for example, a field-programmable gate array (FPGA), an applications specific integrated circuit (ASIC), and the like, and the memory 910 may not be needed or be modified accordingly. In the example illustrated, the memory 910 includes non-transitory, computer-readable memory that stores instructions that are received and executed by the electronic processor 905 to carry out the functionality of the automatic blister card packager 200 described herein. The memory 910 may include, for example, a program storage area and a data storage area. The program storage area and the data storage area may include combinations of different types of memory, such as read-only memory and random-access memory.

The transceiver 915 enables wired or wireless communication between the automatic blister card packager 200 and other devices over one or more communication networks. In other examples, the transceiver 915 may include separate transmitting and receiving components, for example, a transmitter and a receiver.

The input/output interface 920 may include one or more input mechanisms (e.g., a touch screen, a keypad, a button, a knob, and the like), one or more output mechanisms (e.g., a display, a printer, a speaker, and the like), or a combination thereof. The input/output interface 920 receives input from the input devices actuated by a user and provides output to the output devices with which a user interacts. In one example, the input/output interface 920 includes a display configured to display images captured and processed by the automatic blister card packager 200.

The drive systems 925 include, for example, the various drive systems mentioned above for driving the cartridges 325, the shuttle system 340 (e.g., motor assembly 350), the first rail system 405, the second rail system 420, the sealing assembly 500, the loading station 700 (e.g., motors and suction systems), the discharging station 800 (e.g., motors and suction systems), and the like. The drive systems 925 may include a separate electronic processor and memory for controlling the motors, solenoids, etc. The camera systems 930 include, for example, the various cameras and camera systems mentioned above, for example, the camera system 345, camera 375, cameras 390, the vision system of the sealing assembly 500, the first verification camera system 600, the second verification camera system 610, and the like. The sensors 935 may include, for example, the vision system of the sealing assembly 500 and other sensors of the automatic blister card packager 200.

Figure 18:
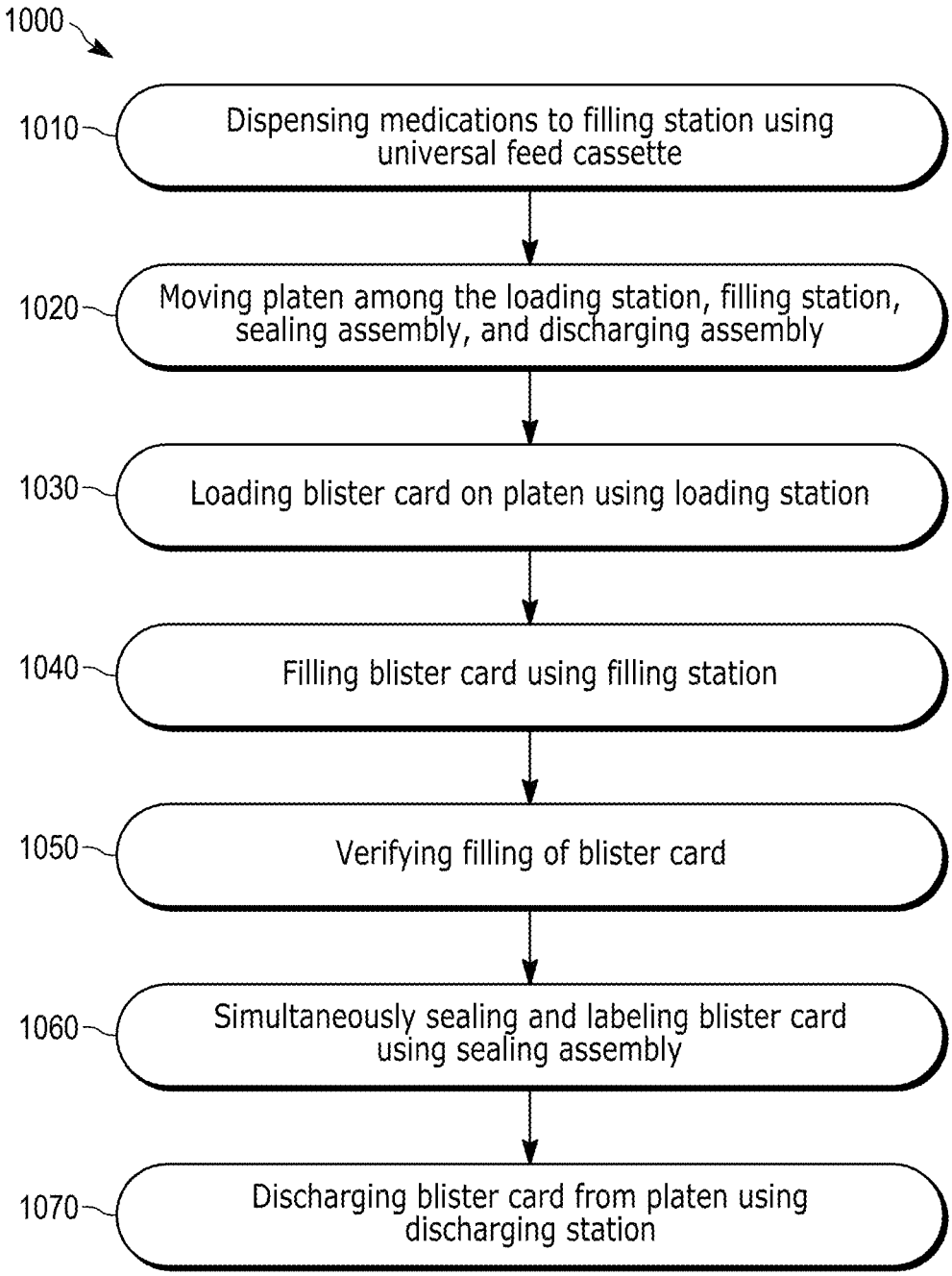
FIG. 18 is a flowchart of an example process implemented by the automatic blister card packager of FIG. 3 in accordance with some examples.

FIG. 18 illustrates a flowchart of an example process 1000 implemented by the automatic blister card packager 200 during operation. The operations of the process 1000 may or may not be performed in order. Some operations may be performed simultaneously with other operations. That is, some of the processes described below are performed at the same time to decrease the packaging time. The process 1000 includes dispensing medications to the filling station 400 using the universal feed cassette 300 (at operation 1010). The electronic processor 905 controls the universal feed cassette 300 to dispense medications individually to the filling station 400 as described below with respect to method 1100.

The process 1000 includes moving the platen 410 among the loading station 700, the filling station 400, the sealing assembly 500, and the discharging station 800 (at operation 1020). The electronic processor 905 controls the first rail drive 415 and the second rail drive 425 to move the platen 410 among the loading station 700, the filling station 400, the sealing assembly 500, and the discharging station 800. One or more position sensors may be used to detect the current position of the platen 410 to control the movement of the platen 410. Within the automatic blister card packager 200, a front-back axis is defined as, for example, a first axis. The filling station 400 is positioned at a back of the automatic blister card packager 200 whereas the loading station 700, the sealing assembly 500, and the discharging station 800 are positioned at a front of the automatic blister card packager 200. The first rail system 405 is used to move the platen 410 along the front-back axis (i.e., the first axis). The electronic processor 905 controls the first rail drive 415 to move the platen 410 along the first axis.

Within the automatic blister card packager 200, a side-side axis (e.g., left-right axis) is defined as, for example, a second axis. In the examples illustrated, the loading station 700 is provided on a right side, the sealing assembly 500 is provided in the middle, the discharging station 800 is provided on a left side along the second axis. In other examples, the loading station 700 may be provided on the left side and the discharging station 800 may be provided on the right side. In still other examples, the loading station 700, the sealing assembly 500, and the discharging station 800 may be arranged in a front-back manner and/or in a non-linear manner. The second rail system 420 is used to move the platen 410 along the second axis. The electronic processor 905 controls the second rail drive 425 to move the platen 410 along the second axis.

Movement between or among the various locations of the platen 410 is therefore achieved by controlling the first rail drive 415 and the second rail drive 425. For example, when an initial position of the platen 410 is the discharging station 800, a movement to the loading station 700 to collect an empty blister card 100 is achieved by controlling the second rail drive 425. For example, the electronic processor 905 may control the second rail drive 425 to move the platen 410 along the second axis from the discharging station 800 to the loading station 700.

Moving the platen 410 from the loading station 700 to the filling station 400 may include controlling the first rail drive 415 and the second rail drive 425. For example, the electronic processor 905 may first control the first rail drive 415 to move the platen 410 along the first axis to behind the loading station 700. The electronic processor 905 then controls the second rail drive 425 to move the platen 410 from behind the loading station 700 to the filling station 400.

Moving the platen 410 from the filling station 400 to the sealing assembly 500 may include controlling the first rail drive 415. For example, the electronic processor 905 controls the first rail drive 415 to move the platen 410 from the filling station 400 to the sealing assembly 500. Moving the platen 410 from the sealing assembly 500 to the discharging station 800 may include controlling the second rail drive 425. For example, the electronic processor 905 may control the second rail drive 425 for sealing and labeling a filled blister card 100 and moving the platen 410 from the sealing assembly 500 to the discharging station 800. Movement of the platen 410 among the various positions may be achieved in other ways than described above.

The process 1000 includes loading a blister card 100 on the platen 410 using the loading station 700 (at operation 1030). The electronic processor 905 controls the first rail drive 415 and/or the second rail drive 425 to move the platen 410 to the loading station 700. The electronic processor 905 controls the card loading assembly 710 and the platen 410 to load a blister card 100 on the platen 410 as described below with respect to method 1200.

The process 1000 includes filling the blister card 100 using the filling station 400 (at operation 1040). The electronic processor 905 controls the universal feed cassette 300 and the platen 410 to fill the blister card 100. Once the blister card 100 is loaded on the platen 410, the electronic processor 905 controls the first rail drive 415 and/or the second rail drive 425 to move the platen 410 to the filling station 400. The electronic processor 905 controls the universal feed cassette 300 to dispense medications to the platen 410 when the platen 410 is at the filling station 400. For example, the electronic processor 905 may move the platen 410 such that a row or column is aligned with the openings in the chute 320. Once aligned, the electronic processor 905 controls the universal feed cassette 300 to dispense the medications through the corresponding tracks such that the medications fall into the blister compartments 120 aligned with the openings. When the aligned blister compartments 120 are filled, the electronic processor 905 moves or indexes to the next row or column of the blister card 100 to fill the next row or column of the 100. This process is repeated until the blister card 100 is filled.

The process 1000 includes verifying filling of the blister card 100 (at operation 1050). The electronic processor 905 uses the first verification camera system 600 and/or the second verification camera system 610 to verify filling of the blister card 100 as described below with respect to method 1300. The electronic processor 905 controls the first verification camera system 600 and/or the second verification camera system 610 to capture one or more images of each (or a plurality of) the blister compartments 120 of the blister card 100 currently being filled. The one or more images may be captured after the medication is dropped into the blister compartment 120. The electronic processor 905 may use image recognition techniques on the captured one or more images to ensure that only a correct type and/or number of medications is delivered to the blister compartment 120. The electronic processor 905 may verify filling of all blister compartments 120 of the blister card 100.

In some examples, the first verification camera system 600 is used to capture images of the blister compartments 120 under the outlets of the chute 320 after each drop of the medication. The electronic processor 905 processes the captured images to verify whether the medication is projecting out of the blister compartment 120. When the medication is projecting out of the blister compartment 120, the electronic processor 905 may control the platen 410 to vibrate, for example, using the first rail drive 415 and/or the second rail drive 425 to settle the medication. The electronic processor 905 may perform successive image captures and vibrations until the medication is settled inside the blister compartment 120 such that the medication may not be sheared when the platen 410 is controlled to move to the next blister compartment 120 (i.e., next indexed location) or when the platen 410 is moved out of the filling station 400.

In some examples, each blister compartment 120 included in a row of the blister card 100 may be filled simultaneously (or relatively simultaneously). In these examples, the electronic processor 905 may control the first verification camera system 600 and/or the second verification camera system 610 to capture one or more images for each row of blister compartments 120 rather than for each blister compartment 120. In other examples, each blister compartment 120 included in a column of the blister card 100 may be filled simultaneously (or relatively simultaneously). In these examples, the electronic processor 905 may control the first verification camera system 600 and/or second verification camera system 610 to capture one or more images for each column of blister compartments 120 rather than for each blister compartment 120. In some examples, the electronic processor 905 captures an image of the entire blister card 100 after filling, for example, after all the desired pills or prescribed medications are dropped into the respective blister compartments 120.

The images of the medication captured by the second verification camera system 610 may be occluded due to the blister compartment. In one example, the second verification camera system 610 may therefore be used to verify the presence of a medication and the first verification camera system 600 may be used to detect the type and/or number of medications in the blister compartment 120. In one example, the first verification camera system 600 may capture the images of the blister compartments 120 through the openings of the filling cover 395 after each drop to verify that the correct type and number of medications were dispensed to each blister compartment 120. The second verification camera system 610 may capture the image of the blister card 100 as a whole after the blister card 100 is completely filled to provide an image of the filled blister card 100. In one example, the second verification camera system 610 captures an image of the filled blister card 100 after the last blister compartment 120 is filled but before the filled blister card 100 is sealed using the sealing assembly 500. In another example, the second verification camera system 610 captures an image of the filled blister card 100 after the filled blister card 100 is sealed using the sealing assembly 500. In this example, the platen 410 may return to the filling station 400 such that the second verification camera system 610 may capture the image before the platen 410 is moved to the discharging station 800. Alternatively, the second verification camera system 610 may be motorized and configured to move under the platen 410 after the filled blister card 100 is sealed while the platen 410 is in the discharging station 800 and move back out of the discharging station 800 before the filled blister card 100 is discharged.

The process 1000 includes simultaneously sealing and labeling (e.g., printing) the blister card 100 using the sealing assembly 500 (at operation 1060). The electronic processor 905 controls the first rail drive 415 and/or the second rail drive 425 to move the platen 410 from the filling station 400 to the sealing assembly 500. The electronic processor 905 controls the sealing assembly 500 and the platen 410 to apply the lid 130 to the filled blister card 100 as described below with respect to method 1300.

The process 1000 includes discharging the blister card 100 from the platen 410 using the discharging station 800 (at operation 1070). The electronic processor 905 controls the first rail drive 415 and the second rail drive 425 to move the platen 410 from the sealing assembly 500 to the discharging station 800. The electronic processor 905 controls the card discharging assembly 810 to discharge the blister card 100 from the platen 410 as described below with respect to method 1400.

Figure 19:
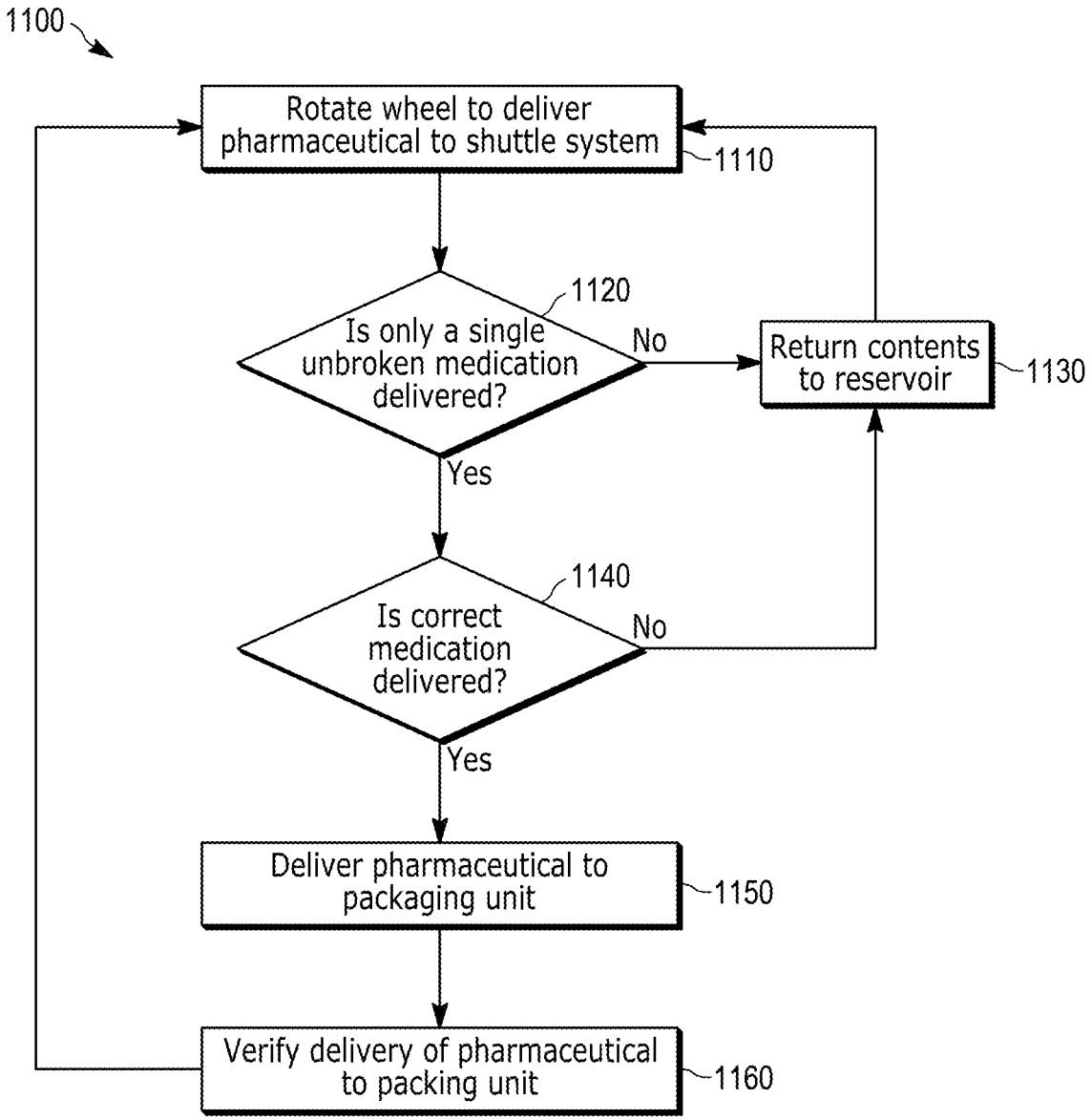
FIG. 19 is a flowchart of an example method for dispensing medications using the universal feed cassette of FIG. 5 in accordance with some examples.

FIG. 19 is a flowchart illustrating one example method 1100 of dispensing medications using the universal feed cassette 300. As illustrated in FIG. 19, the method 1100 includes rotating the wheel 335 to deliver a medication to the shuttle system 340 (at block 1110). The electronic processor 905 controls the motor assembly 350 to rotate the wheel 335. The automatic blister card packager 200 may pack only a single medication of a kind in any one blister compartment 120. Accordingly, the cartridge 325 may need to verify that an expected medication (for example, a single unbroken medication) is dispensed to the filling station 400. The method 1100 further includes determining whether only a single unbroken medication is delivered to the shuttle system 340 (at block 1120). This may also be referred to as singulation verification. The electronic processor 905 controls the camera system 345 to acquire an image of contents of the platform 355. The electronic processor 905 may use image recognition techniques on the captured image to ensure that only a single unbroken medication is delivered to the shuttle system 340.

When the electronic processor 905 determines that more than one medication has been delivered to the shuttle system 340 or that a broken medication has been delivered to the shuttle system 340, the method 1100 includes returning the contents of the shuttle system 340 to the reservoir of the cartridge 325 (at block 1130). The electronic processor 905 controls the shuttle drive 365 to move the shuttle 360 from the platform 355 to a first opening (e.g., the first position). The shuttle 360 returns the contents from the platform 355 to the reservoir through the first opening. The method 1100 returns to block 1110 to deliver the next medication to the shuttle system 340.

When the electronic processor 905 determines that only one unbroken medication has been delivered to the shuttle system 340, the method 1100 includes determining whether the correct medication is delivered to the shuttle system 340 (at block 1140). As described above, the electronic processor 905 may use the above incorporated image recognition techniques to determine whether the correct type of medication has been delivered to the shuttle system 340.

When the electronic processor 905 determines that the incorrect type of medication is delivered to the shuttle system 340, the method 1100 moves to block 1130 to return the contents of the shuttle system 340 to the reservoir, as described above. Accordingly, in blocks 1120 and 1140, the method 1100 is determining whether an expected medication is delivered to the shuttle system 340. In some embodiments, determining whether an expected medication is delivered may include only one of the blocks 1120 or 1140 or the blocks 1120 and 1140 may be performed in a different order. In other embodiments, rather than checking for whether a single unbroken medication is delivered to the shuttle system 340, determining whether an expected medication is delivered may include determining whether a correct type of medication is delivered to the shuttle system 340 regardless of the number of medications delivered to the shuttle system 340. In yet other embodiments, determining whether an expected medication may include determining whether a correct number of medications is delivered to the shuttle system 340 without determining the type of medication delivered to the shuttle system 340.

When the electronic processor 905 determines that the correct type of medication is delivered to the shuttle system 340, the method 1100 includes delivering the medication to the filling station 400 (at block 1150). The electronic processor 905 controls the shuttle drive 365 to move the shuttle 360 from the platform 355 to a second opening (e.g., the second position). The shuttle 360 delivers the medication from the platform 355 to the filling station 400 through the second opening, the conduit 370, and a dispensing opening 315.

The method 1100 also includes verifying the delivery of the medication to the filling station 400 (at block 1160). The camera 375 (or pill sensors) detects whether or not a pill was dispensed through the dispensing openings 315 and provides indicating signals to the electronic processor 905. When the electronic processor 905 determines that a medication was delivered to the filling station 400, the method 1100 returns to block 1110 to deliver the next medication. When the electronic processor 905 determines that a medication was not delivered to the filling station 400, the electronic processor 905 may optionally send an interrupt to the control system of the automatic blister card packager 200 and returns to block 1110 to re-deliver the medication.

Figure 20:
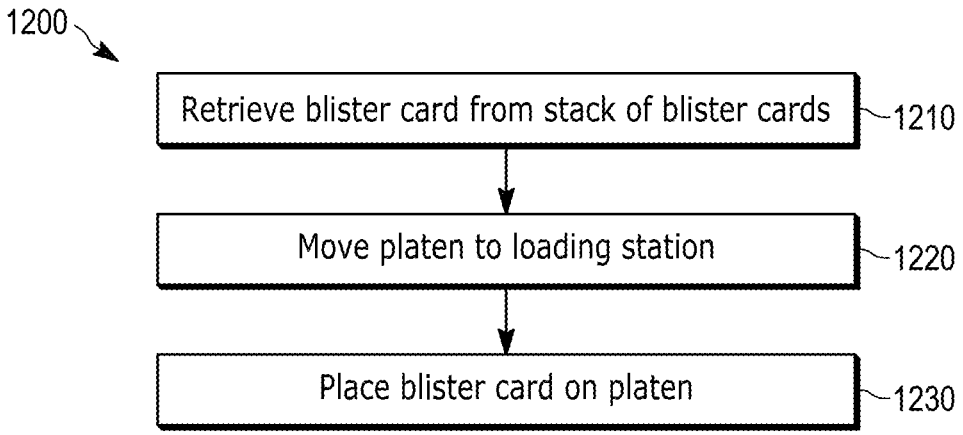
FIG. 20 is a flowchart of an example method for loading a blister card using the automatic blister card packager of FIG. 3 in accordance with some examples.

FIG. 20 is a flowchart illustrating one example method 1200 for loading a blister card 100 using the automatic blister card packager 200. As illustrated in FIG. 20, the method 1200 includes retrieving, using the loader plate 730, a blister card 100 from a stack of blister cards 100 (at block 1210). The card plate 725 holds a stack of blister cards 100. In one example, the electronic processor 905 moves the loader plate 730 to the top of the stack of blister cards 100. The electronic processor 905 controls, for example, the loader drive assembly 720 or a different drive mechanism to move the loader plate 730 downwards to the top of the stack of blister cards 100. In some examples, the loader plate 730 may be stationary and the card plate 725 may be moved upwards to the loader plate 730 using the loader drive assembly 720. The electronic processor 905 may activate a suction system (e.g., a suction motor) of the loader plate 730 to generate a suction force through the one or more nozzles 750. The suction force results in the blister card 100 being picked up by the loader plate 730. The electronic processor 905 may activate the suction system in response to or after the loader plate 730 is at the top of the blister card 100. In some examples, a different mechanism such as a robotic arm or the like may be used to retrieve the blister card 100 using the loader plate 730. Once the blister card 100 is retrieved by the loader plate 730, the electronic processor 905 may move the loader plate 730 upward (or move the card plate 725 downward) to the initial position.

The method 1200 includes moving the platen 410 to the loading station 700 (at block 1220). The electronic processor 905 controls the first rail drive 415 and/or the second rail drive 425 to move the platen 410 to the loading station 700 as described above. The electronic processor 905 may move the platen 410 to the loading station 700 in response to or after the blister card 100 is retrieved by the loader plate 730. The electronic processor 905 may control the first rail drive 415 and/or the second rail drive 425 to align the platen 410 with the blister card 100.

The method 1200 includes placing, using the loader plate 730, the blister card 100 on the platen 410 (at block 1230). The electronic processor 905 may deactivate the suction system of the loader plate 730 to drop (e.g., deposit) the blister card 100 on the platen 410. The suction system may be deactivated in response to or after the platen 410 is moved to the loading station 700. In some examples, the loader plate 730 may be moved downward to the platen 410 to bring the blister card 100 closer to the platen 410 before the suction system is deactivated. In some examples, a positive pressure may be applied using the suction system to drop the blister card 100 from the loader plate 730. The platen 410 may be moved to the filling station 400 after the blister card 100 is loaded to fill the blister card 100.

In some examples, the method 1200 may further include moving the card plate 725 upward by a certain distance in response to or after a blister card 100 is retrieved from the stack of blister cards 100. The distance is, for example, 0.06 inches and corresponds to a dimension (e.g., a height) of each blister card 100 in the stack of blister cards 100. The card plate 725 may be moved upward by the screw 735 and the motor 740. In other examples, the card plate 725 may be biased upwardly by, for example, one or more springs. Moving the card plate 725 upwardly an incremental amount after each blister card 100 is retrieved from the stack of blister cards 100 maintains the next blister card 100 to be removed at the same position (e.g., vertical height) relative to the loader plate 730. As such, the loader plate 730 can move the same distance each time to retrieve a blister card 100 and does not need to adjust based on the number of blister cards 100 remaining in the stack of blister cards 100.

Figure 21:
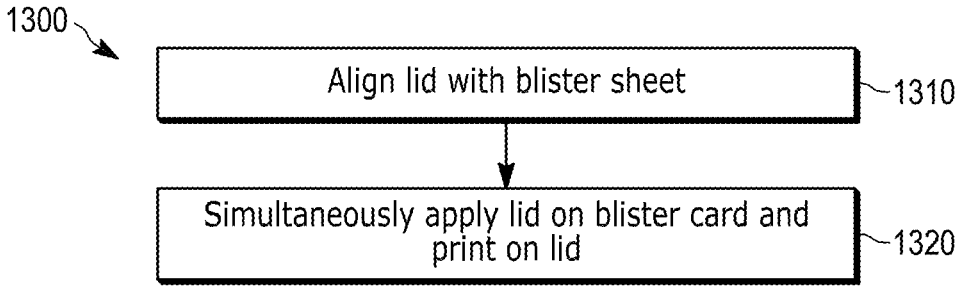
FIG. 21 is a flowchart of an example method for sealing a blister card using the automatic blister card packager of FIG. 3 in accordance with some examples.

FIG. 21 is a flowchart illustrating one example method 1300 for sealing a blister card 100 using the automatic blister card packager 200. As illustrated in FIG. 21, the method 1300 includes aligning, using the vision system of the sealing assembly 500, a lid 130 with the blister card 100 (at block 1310). The electronic processor 905 uses the vision system of the sealing assembly 500 to determine whether the lid 130 is aligned with the blister card 100 on the platen 410. The electronic processor 905 controls the platen 410 and the lid roll holder assembly 505 to align the lid 130 just above the blister card 100 on the platen 410.

The method 1300 includes simultaneously applying the lid 130 on the blister card 100 and printing on the lid 130 (at block 1320). The electronic processor 905 controls the lid roll holder assembly 505 to dispense the lid 130 onto the blister card 100 on the platen 410. Simultaneously, the electronic processor 905 controls the platen 410 to move right to left as the lid 130 is being dispensed to apply the lid 130 to the blister card 100 on the platen 410. In some examples, the platen 410 may stay stationary while the sealing assembly 500 is moved to the right to apply the lid 130 to the blister card 100 on the platen 410. The print roller 515 prints the label information, for example, patient name, facility name, medication information (e.g., name, dosage, etc.), dosage information, and/or the like on the lid 130. The print roller 515 may also apply pressure and/or heat to the lid 130 to activate the adhesive on the lid 130.

Figure 22:
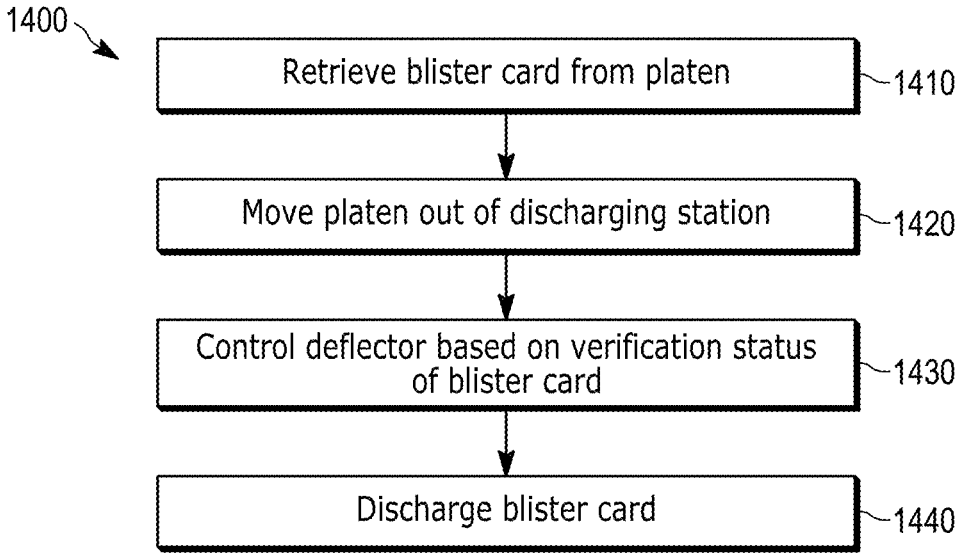
FIG. 22 is a flowchart of an example method for discharging a filled blister card the automatic blister card packager of FIG. 3 in accordance with some examples.

FIG. 22 is a flowchart illustrating one example method 1400 for discharging a filled blister card 100 using the automatic blister card packager 200. As illustrated in FIG. 22, the method 1400 includes retrieving, using the discharger plate 830, a blister card 100 from the platen 410 (at block 1410). The electronic processor 905 controls, for example, the discharger drive assembly 820 or a different drive mechanism to move the discharger plate 830 downwards to the top of the platen 410. The electronic processor 905 may activate a suction system (e.g., a suction motor) of the discharger plate 830 to generate a suction force through the one or more nozzles 825. The suction force results in the blister card 100 being picked up by the discharger plate 830. The electronic processor 905 may activate the suction system in response to or after the platen 410 is at the discharging station 800 and/or aligned with the discharger plate 830. In some examples, a different mechanism such as a robotic arm or the like may be used to retrieve the blister card 100 using the discharger plate 830. Once the blister card 100 is picked up by the discharger plate 830, the electronic processor 905 may move the discharger plate 830 upward to the initial position.

The method 1400 includes moving the platen 410 out of the discharging station 800 (at block 1420). The electronic processor 905 controls the first rail drive 415 and/or the second rail drive 425 to move the platen 410 out of the discharging station 800. For example, the platen 410 may be moved to the loading station 700 to retrieve the next blister card 100. The electronic processor 905 may move the platen 410 out of the discharging station 800 in response to or after the blister card 100 is retrieved by the discharger plate 830. The electronic processor 905 may control the first rail drive 415 and/or the second rail drive 425 to align the platen 410 with the blister card 100.

The method 1400 includes controlling the deflector 835 based on the verification status of the blister card 100 (at block 1430). Each filled blister card 100 may be verified using a verification system. For example, each filled blister card 100 may be verified as described above with respect to operation 1050. The electronic processor 905 determines whether the blister card 100 is correctly packaged or incorrectly packaged based on the verification performed at operation 1050. The electronic processor 905 controls the deflector 835 based on the verification status. For example, the electronic processor 905 controls deflector 835 using the motor 840 to be in one of the first position (shown in FIG. 15) or the second position (shown in FIG. 16) when the blister card 100 is correctly packaged and in the other of the first position or the second position when the blister card 100 is incorrectly packaged.

The method 1400 includes discharging, using the discharger plate 830, the blister card 100 (at block 1440). The electronic processor 905 may deactivate the suction system of the discharger plate 830 to drop the blister card 100 in the discharging enclosure 805. The suction system may be deactivated in response to or after the platen 410 is moved out of the discharging station 800 and/or the after the deflector 835 is in a position corresponding to the verification status of the blister card 100. As the suction system is deactivated, the blister card 100 drops from the discharger plate 830 and either falls out of the discharging enclosure 805 or the automatic blister card packager 200 when the deflector 835 is in the path of the blister card 100 or falls into the discharging enclosure 805 when the deflector 835 is out of the path of the blister card 100. In one example, a tote or container may be provided outside the discharging enclosure 805 to receive the correctly filled blister cards 100. In another example, a conveyor belt may be provided outside the discharging enclosure 805 in the path of filled blister card 100 when the deflector 835 is in the first position (e.g., FIG. 15). The conveyor below may receive the filled blister cards 100 and may be configured to carry the filled blister cards 100 to another location within the facility. When the deflector 835 is in the path of the blister card 100, the deflector 835 guides the blister card 100 out of the discharging enclosure 805 into the tote, container, or conveyor belt (see e.g., FIG. 15). In some examples, the deflector 835 may direct the blister card 100 to a different part of the discharging enclosure 805 rather than out of the discharging enclosure 805 or out of the automatic blister card packager 200. The incorrectly filled blister cards 100 may be directed to within the discharging enclosure 805 to be collected later. In some instances, the verification system may incorrectly determine that the blister card 100 is incorrectly filled. In these instances, the pharmacist or technician may manually verify the filled blister cards 100 that are deemed to be incorrectly filled by the verification system before being discarded or accepted.

Example 1. An automatic blister card packager comprising: a platen configured to receive a blister card; a loading station including a loader configured to retrieve an empty blister card from a stack of blister cards and deposit the empty blister card on the platen; a filling station configured to fill the empty blister card supported by the platen with medications; and a discharging station including a discharger configured to retrieve the filled blister card from the platen and discharge the filled blister card from the automatic blister card packager.

Example 2. The automatic blister card packager of Example 1, wherein the platen is movable between the loading station, the filling station, and the discharging station.

Example 3. The automatic blister card packager of any of Examples 1-2, wherein the loading station further includes: a base for storing the stack of blister cards, the base moveable along a track, wherein the base is configured to move along the track towards the loader in response to the loader retrieving the empty blister card from the stack of blister cards.

Example 4. The automatic blister card packager of any of Examples 1-3, wherein the loader is configured to move along a track towards the platen to retrieve the empty blister card from the stack of blister cards.

Example 5. The automatic blister card packager of any of Examples 1-4, wherein the filling station further includes: a chute configured to deliver medications dispensed from one or more cartridges to the empty or partially filled blister card on the platen; and a filling cover including one or more openings corresponding to one or more outlets of the chute and configured to at least partially cover the empty or partially filled blister card when the medications are delivered to the empty or partially filled blister card.

Example 6. The automatic blister card packager of any of Examples 1-5, wherein the discharging station includes a deflector positioned below the discharger and configured to be moved between a first position and a second position.

Example 7. The automatic blister card packager of Example 6, wherein the deflector is in a path of the filled blister card when in the first position and out of the path of the filled blister card when in the second position.

Example 8. The automatic blister card packager of any of Examples 1-7, further comprising a rail system configured to move the platen between the loading station, the filling station, and the discharging station.

Example 9. The automatic blister card packager of any of Examples 1-8, further comprising a sealing assembly configured to simultaneously apply a lid to the filled blister card and print on the lid while the filled blister card is supported by the platen.

Example 10. A blister card loader comprising: a base for storing a stack of blister cards, the base moveable along a track; a loader configured to retrieve an empty blister card from the stack of blister cards; and a platen configured to receive the empty blister card from the loader for filling, wherein the base is configured to move along the track towards the loader in response to the loader retrieving the empty blister card from the stack of blister cards.

Example 11. The blister card loader of Example 10, further comprising: a base actuator coupled to the base and configured to move the base along the track; a loader actuator coupled to the loader and configured to actuate the loader to retrieve the empty blister card; and an electronic processor electrically coupled to the base actuator and the loader actuator, the electronic processor configured to: operate, using the loader actuator, the loader to retrieve the empty blister card from the stack of blister cards; and operate, using a base actuator, the base to move towards the loader by a distance corresponding to a dimension of the empty blister card in response to operating the loader to retrieve the empty blister card from the stack of blister cards.

Example 12. The blister card loader of any of Examples 10-11, wherein the loader includes a suction system and one or more nozzles, the suction system configured to selectively generate a suction force through the one or more nozzles to retrieve the empty blister card from the stack of blister cards.

Example 13. The blister card loader of Example 12, wherein the suction system is selectively deactivated to place the empty blister card on the platen.

Example 14. The blister card loader of Example 12, wherein the suction system is configured to generate a positive pressure to place the empty blister card on the platen.

Example 15. The blister card loader of any of Examples 10-14, wherein the loader is configured to be moveable along the track.

Thus, the present disclosure provides, among other things, an automatic blister card packager.

What is claimed is:

1. An automatic blister card packager comprising:

a platen configured to receive blister cards;

a loading station including a loader configured to retrieve an empty blister card from a stack of blister cards and deposit the empty blister card on the platen;

a filling station configured to fill the empty blister card supported by the platen with medications; and a discharging station including a discharger configured to retrieve the filled blister card from the platen and discharge the filled blister card from the automatic blister card packager.

2. The automatic blister card packager of claim 1, wherein the platen is movable between the loading station, the filling station, and the discharging station.

3. The automatic blister card packager of claim 2, wherein the platen is movable between the loading station, the filling station, and the discharging station along an x-axis or a y-axis.

4. The automatic blister card packager of claim 1, wherein the loading station further includes:

a base for storing the stack of blister cards, the base moveable along a track, wherein the base is configured to move along the track towards the loader in response to the loader retrieving the empty blister card from the stack of blister cards.

5. The automatic blister card packager of claim 1, wherein the loader is configured to move along a track towards the platen to retrieve the empty blister card from the stack of blister cards.

6. The automatic blister card packager of claim 1, wherein the filling station further includes:

a chute configured to deliver medications dispensed from one or more cartridges to the empty or partially filled blister card on the platen via an outlet; and a filling cover including one or more openings corresponding to one or more outlets of the chute and configured to at least partially cover the empty or partially filled blister card from the outlet of the chute when the medications are delivered to the empty or partially filled blister card.

7. The automatic blister card packager of claim 1, wherein the discharging station includes a deflector positioned below the discharger and configured to be moved between a first position and a second position.

8. The automatic blister card packager of claim 7, wherein the deflector is in a path of the filled blister card such that the deflector blocks the filled blister card from proceeding along the path when in the first position and out of the path of the filled blister card when in the second position.

9. The automatic blister card packager of claim 1, further comprising a rail system configured to move the platen between the loading station, the filling station, and the discharging station.

10. The automatic blister card packager of claim 1, further comprising a sealing assembly configured to simultaneously apply a lid to the filled blister card and print on the lid while the filled blister card is supported by the platen.

11. A blister card loader comprising:

a base for storing a stack of blister cards, the base moveable along a track;

a loader configured to retrieve an empty blister card from the stack of blister cards;

a platen configured to receive the empty blister card from the loader for filling, wherein the base is configured to move along the track towards the loader in response to the loader retrieving the empty blister card from the stack of blister cards;

a base actuator coupled to the base and configured to move the base along the track;

a loader actuator coupled to the loader and configured to actuate the loader to retrieve the empty blister card; and an electronic processor electrically coupled to the base actuator and the loader actuator, the electronic processor configured to:

operate, using the loader actuator, the loader to retrieve the empty blister card from the stack of blister cards; and operate, using a base actuator, the base to move towards the loader by a distance corresponding to a dimension of the empty blister card in response to operating the loader to retrieve the empty blister card from the stack of blister cards.

12. The blister card loader of claim 11, wherein the loader includes a suction system and one or more nozzles, the suction system configured to selectively generate a suction force through the one or more nozzles to retrieve the empty blister card from the stack of blister cards.

13. The blister card loader of claim 12, wherein the suction system is selectively deactivated to place the empty blister card on the platen.

14. The blister card loader of claim 12, wherein the suction system is configured to generate a positive pressure to place the empty blister card on the platen.

15. The blister card loader of claim 11, wherein the loader is configured to be moveable along the track.

* * * * *